US005560552A

United States Patent [19]

Powell et al.

[11] Patent Number: 5,560,552

[45] Date of Patent: Oct. 1, 1996

[54] CONTAINER CUTTING ASSEMBLY

[75] Inventors: Ken R. Powell, Centreville; David M. Alexander, Purcellville, both of Va.; John Millhiser, Aldie, all of Va.

[73] Assignee: Environmental Products Corporation, Fairfax, Va.

[21] Appl. No.: 150,830

[22] Filed: Nov. 12, 1993

[51] Int. Cl.[6] ..... B02C 18/06; B02C 18/18; B02C 18/40

[52] U.S. Cl. ..... 241/100; 241/166; 241/236; 241/282.1; 241/292.1

[58] Field of Search ..... 241/99, 100, 166, 241/167, 236, 290, 282.1, 292.1

[56] References Cited

U.S. PATENT DOCUMENTS

| | | | |
|---|---|---|---|
| 878,676 | 2/1908 | Scharf . | |
| 3,310,086 | 3/1967 | Lasar . | |
| 3,845,907 | 11/1974 | Schwarz | 241/36 |
| 3,860,180 | 1/1975 | Goldhammer | 241/27 |
| 3,880,361 | 4/1975 | Schwarz | 241/36 |
| 3,991,944 | 11/1976 | Baikoff | 241/36 |
| 4,257,565 | 3/1981 | Hatanaka | 241/100 |
| 4,285,426 | 8/1981 | Cahill | 194/4 |
| 4,625,925 | 12/1986 | Goldhammer | 241/236 |
| 4,717,085 | 1/1988 | Crane | 241/236 |
| 4,729,515 | 3/1988 | Wagner | 241/99 |
| 4,799,627 | 1/1989 | Potts | 241/236 |
| 4,919,345 | 4/1990 | Burlington et al. | 241/36 |
| 4,923,126 | 5/1990 | Lodovico et al. | 241/30 |
| 4,923,130 | 5/1990 | Campbell | 241/236 |
| 5,141,168 | 8/1992 | Pepper | 241/236 |
| 5,152,469 | 10/1992 | Dicky | 241/236 |
| 5,160,095 | 11/1992 | Pepper | 241/46.06 |
| 5,178,336 | 1/1993 | Lodovico et al. | 241/99 |
| 5,248,102 | 9/1993 | Bohn | 241/99 |

FOREIGN PATENT DOCUMENTS

| | | | |
|---|---|---|---|
| 0182749 | 5/1986 | European Pat. Off. | 241/236 |
| 2514432 | 10/1976 | Germany . | |

*Primary Examiner*—John Husar

*Attorney, Agent, or Firm*—Finnegan, Henderson, Farabow, Garrett & Dunner, L.L.P.

[57] ABSTRACT

A container cutting assembly includes first and second parallel counter-rotatable shafts defining first and second axes. A first and second plurality of cutting wheels are positioned on the first and second shafts, respectively, interleaved with cutting wheels on the other shaft. Each cutting wheel has several cutting teeth, each tooth having a leading surface and two trailing surfaces. The second trailing surface has a preselected length. The leading surface and first trailing surface define a cutting edge, which is skewed with respect to the respective axis, defining a cutting point. Each cutting wheel is positioned on the shaft such that each cutting point of each tooth passes between two second trailing surfaces of cutting teeth disposed on either side approximately midway along the preselected lengths thereof. The cutting points of corresponding teeth in each plurality of cutting wheels align in lines which are parallel and coplanar to the respective axes. A driver drives the shafts, and a suspension system is provided between the driver and the shafts to absorb and release excess energy applied to the assembly.

44 Claims, 14 Drawing Sheets

CONTAINER CUTTING ASSEMBLY

FIELD OF THE INVENTION

The present invention relates to a container cutting device used to cut plastic bottles and aluminum cans into small chips. More specifically, it relates to a container cutting device which is used in a Reverse Vending Machine (RVM).

DESCRIPTION OF THE RELATED ART

With the increased emphasis on environmental cleanup in recent years, many Jurisdictions have enacted legislation mandating the recycling of beverage containers. Post-consumer beverage containers typically comprise a major portion of garbage dumps and landfills.

A known device for recycling post-consumer beverage containers is a Reverse Vending Machine. An RVM is similar in outward appearance to a conventional beverage vending machine, and is used to recycle glass bottles, plastic bottles, and aluminum cans. An RVM is typically set up in an area where consumers come to return beverage containers, such as outside a grocery store. The consumer operates the RVM by inserting a participating container (i.e., a container containing proper bar-coded information revealing it to be a refundable container) into an acceptance port in the cabinet. Various sensing devices sense the container (1) to ensure it is a participating container, (2) to determine its material of composition (e.g., plastic, glass, aluminium), (3) to determine its color. Participating containers either are crushed or shredded, and then transferred to a storage bin for later removal. The RVM may issue some sort of refund (e.g., cash, vouchers, or coupons) to the consumer.

At a later time, an operator empties the storage bin of the crushed or shredded ("densified") material, and transports the densified material to a recycling center. In recent RVMs, removal of the densified material has been performed using pneumatic devices, such as vacuum blowers and hoses. In order for a pneumatic removal system to operate effectively, it is important for the densified material to be small enough to be transported in the air stream. Therefore, when shredding devices are used to densify plastic or aluminum containers, it is important that the shredding devices cut the plastic or aluminum into small chips, because it is difficult to remove long, heavy strips with the pneumatic devices.

Related shredders used in RVMs consist of two parallel counter-rotating shafts, each shaft supporting a plurality of cutting wheels which are interleaved with corresponding cutting wheels on the other shaft. Teeth project from outer peripheries of the cutting wheels. A feeding mechanism normally is positioned above the cutting wheel shafts, consisting of two more counter-rotating shafts supporting a plurality of rigid feed paddles. The feeding mechanism grips a container between two opposed paddles, and simultaneously grips it and feeds it between the cutting wheel shafts to be shredded by the teeth on the cutting wheels.

RVM operators have suffered from drawbacks in these related shredders. These drawbacks can be understood by considering such a related shredder used in an RVM, depicted in FIG. 11. Housing 221 supports shredder 220, which as shown in FIG. 11 consists of two parallel counter-rotating shafts 222, 224, each shaft defining an axis. A first plurality of cutting wheels 226 are mounted on shaft 222, while a second plurality of cutting wheels 228 are mounted on shaft 224. Cutting wheels 226 are interleaved with cutting wheels 228.

Each cutting wheel 226 and 228 has a plurality of teeth 230. Each tooth has a leading surface 232 and a trailing surface 234. These two surfaces meet to form an apex 236 which serves as a cutting edge. Apex 236 leads both the leading surface 232 and trailing surface 234 as the cutting wheel rotates. The apex 236 strikes a container first as the container is fed into the shredder.

The related shredder 220 further includes a feeding device 240, consisting of two counter-rotating feed shafts 242, 244, positioned generally above the cutter shafts 222, 224. Rigid paddles 246 project at periodic intervals from feed shaft 242, while rigid paddles 248 project at periodic intervals from feed shaft 244. The rotation of feed shafts 242, 244 is timed so that each pair of paddles 246, 248, will directly oppose each other as they pass through an imaginary plane containing feed shafts 242, 244, so that a container passing through the feed device will be gripped between two opposing paddles 246, 248.

Housing 210 further supports a motor and gears (not shown) for driving and interconnecting cutting shafts 222, 224.

As noted above, each tooth 230 on the cutting wheels has an apex 236. Each apex 236 forms a ridge or line which is parallel to the axis defined by the respective shaft 222 or 224. Moreover, as depicted in FIG. 12, each cutting wheel 226, 228 is mounted on its respective shaft in a staggered position with respect to the next adjacent cutting wheel. Therefore, each corresponding tooth 230 and apex 236 is also staggered with respect to the adjacent tooth and apex.

The shredder described above operates as follows. A plastic or aluminum container "c" is fed into an opening in the housing directly above rotating shafts 242, 244. The container is gripped between two opposing paddles 246,248, and simultaneously gripped and fed downward between counter-rotating shafts 222, 224. As it is fed downward, the container is struck on each side by apexes 236 of teeth 230 on interleaved cutting wheels. As each apex 236 strikes the material, the wall of the container bends and wraps around the apex, while still being gripped by feed paddles 246, 248. The result of this process is depicted in FIG. 13. The bending and wrapping around the tooth while being gripped above causes the container material to be pulled until it tears along a horizontal line "h" corresponding to the line of the apex 236, and to shred downward in two parallel side cuts "$s_1$", "$s_2$", each side cut perpendicular to the horizontal tearing line "h". As the next tooth 230 strikes the material, a new pulling, tearing, and shredding action commences. In this manner, under ideal conditions, the material is shredded into a number of small strips, each strip having a length approximately equal to the sum of the length of a trailing surface 232 plus the length of a leading surface 234 of tooth 230, and a width approximately equal to the width of a cutting wheel. Furthermore, because the apexes of the teeth are staggered, each sequential apex 236 strikes container "c" shortly after the preceding apex 236. The torn strips drop downward to a storage bin for later pneumatic removal.

As noted above, these related shredders suffer several drawbacks in an RVM environment. First, the pulling, tearing, and shredding process described above does not work very effectively with plastic bottles, because the plastic material is tough and has a high modulus of elasticity. Second, the pulling, tearing, and shredding process works properly only while the apexes 236 are sharp. As container after container is shredded, however, the apexes 236 tend to become dull. As the apexes 236 become dull, the tearing action along the horizontal line "h" corresponding to each apex 236 begins to fail on plastic containers. Eventually, tearing of plastic along the line "h" of apex 236 becomes sporadic or stops altogether. Consequently, a plastic container is shredded into several long strips, each strip demonstrating creases in numerous locations along its length where the plastic material bent around apexes 236 of sequential teeth 230 but did not tear. Many of these long strips are too heavy to be removed by the pneumatic removal device, particularly when they are also caked with dirt or beverage syrup, and tend to pile up below the shredder. This pile subsequently can reduce the removal capability of the system, can result in cross-contamination of different types of container material deposited in the RVM, or can even pile up to the point of clogging the shredder itself.

A related problem results from the ineffectiveness of the shredder when used with plastic bottles. The same shredder may shred aluminum effectively, making it difficult for maintenance personnel to adjust the same shredder to handle both aluminum and plastic. RVM operators have elected typically to use one shredder for plastic, and another for aluminum.

Another problem with the related shredders occurs at the ends of shafts 222, 224, where they penetrate the housing 210. Strips of shredded container material caked with beverage syrup and dirt tend to collect here, interfering with the rotation of the shaft.

These related shredders often suffer broken cutting wheels. Several new plastic bottles have been put into the consumer stream which have base cups made of excessively thick plastic. Additionally, RVMs are occasionally subjected to vandalism or fraud attempts by consumers, with rocks or other hard objects being fed into the shredder. When the cutting wheel teeth strike these hard objects, the force generated by striking the objects acts counter to the force applied to the shaft by the motor. A frequent result is that teeth 230 break off the cutting wheels, or entire wheels crack.

The related shredder described above requires cooperation between the cutting wheels and the feed paddles, because the feed paddles must grip the container and feed it slowly, while the teeth of the cutting wheels bend, tear and shred strips off of the container. The feed paddles, however, are an extra part, resulting in additional expense and maintenance.

SUMMARY OF THE INVENTION

Accordingly, the present invention is directed to a container cutting device that substantially avoids one or more of the problems caused by the limitations and disadvantages of the related art.

Additional features and advantage of the invention will be set forth in the description which follows, and in part will be apparent from the description, or may be learned by practice of the invention. The objectives and other advantages of the invention will be realized and attained by the apparatus particularly pointed in the written description and claims as well as the attached drawings.

To achieve these and other advantages and in accordance with the purpose of the invention, as embodied and broadly described, the present invention is a container cutting assembly. The assembly comprises first and second parallel counter-rotatable shafts defining respective first and second axes. A first and second plurality of cutting wheels are positioned on the first and second shafts, respectively, the first plurality of cutting wheels on the first shaft being interleaved with the second plurality of cutting wheels on the second shaft. Each cutting wheel in the first and second plurality of cutting wheels includes a plurality of teeth. Each tooth includes a leading surface and first and second trailing surfaces. The second trailing surfaces have a preselected length. Each leading surface and first trailing surface meet to define a cutting edge. Each cutting edge is skewed with respect to its respective axis to define a cutting point. Each cutting wheel is rotatable with its respective shaft such that each cutting point leads both the leading surface and the cutting edge of the respective tooth. Each cutting wheel is positioned on its respective shaft such that each cutting point on each tooth of each cutting wheel passes two second trailing surfaces of corresponding teeth of cutting wheels on the other shaft disposed on either side of the respective cutting wheel, approximately midway along the preselected lengths of the two second trailing surfaces.

In another aspect of the invention, the cutting points of the teeth on each cutting wheel of the respective plurality of cutting wheels align with one another defining a line parallel and coplanar to the respective axis.

In another aspect of the invention, the assembly includes a third rotatable shaft positioned generally above one of the first and second shafts. A pliable paddle projects from the third shaft.

In another aspect of the invention, the assembly includes a housing provided around the first and second shafts having side walls with apertures, the first and second shafts projecting through the apertures. First and second deflectors are provided proximate each of the side walls, the first deflector having an arcuate lower portion at least partially encircling one cutting wheel on the first shaft, and the second deflector having an arcuate lower portion at least partially encircling one cutting wheel on the second shaft.

In another aspect of the invention, a driver is provided including a motor and gearing for driving and interlinking the first and second shafts. A suspension system is provided between the driver and the shafts to absorb and release excess energy applied to the assembly.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate one embodiment of the invention, and together with the description serve to explain the principles of the invention.

DESCRIPTION OF THE PREFERRED EMBODIMENT

Reference will now be made in detail to the present preferred embodiment of the invention, an example of which is illustrated in the accompanying drawings.

A container cutting assembly according to the present invention comprises first and second counter-rotatable shafts defining respective first and second axes.

Figure 1:
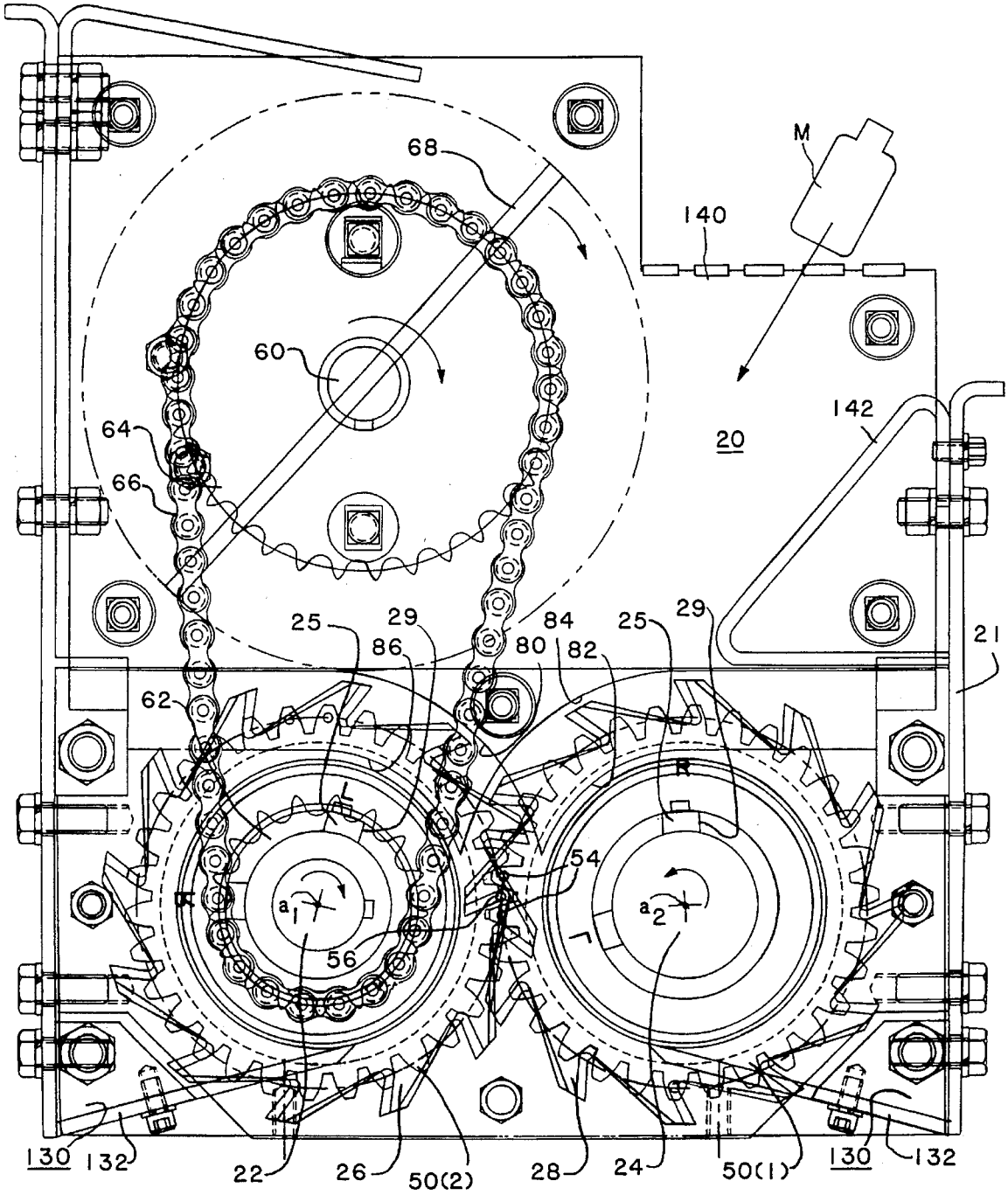
FIG. 1 is a cutaway side view of an embodiment of a container cutting assembly according to the present invention.

The exemplary embodiment of the container cutting assembly of the present invention is shown in FIG. 1 and is designated generally by reference numeral 20.

As embodied herein, and referring to FIG. 1, a container cutting assembly 20 includes a housing 21, rotatably supporting a first shaft 22 defining a first axis $a_1$, and a second shaft 24 defining a second axis $a_2$. First shaft 22 and second shaft 24 are parallel to one another, and spaced apart a preselected distance, preferably about 5.0 inches, and have a preferred diameter of approximately 2.5 inches. Each shaft projects through apertures in housing 21 (not shown in FIG. 1 but discussed in greater detail below). Each shaft is geared to rotate in a direction that is opposite to the direction of rotation of the other shaft, as shown in FIG. 1. Each shaft has a ¼ inch wide and ⅛ inch deep keyslot (not shown) extending in a generally straight line along its length. A ¼ inch by ¼ inch piece of elongated steel keystock 25 is inserted into the keyslot in each shaft 22, 24.

In accordance with the present invention, a container cutting assembly further comprises a first and second plurality of cutting wheels positioned on the first and second shafts, respectively. The first plurality of cutting wheels are interleaved with the second plurality of cutting wheels.

Figure 2:
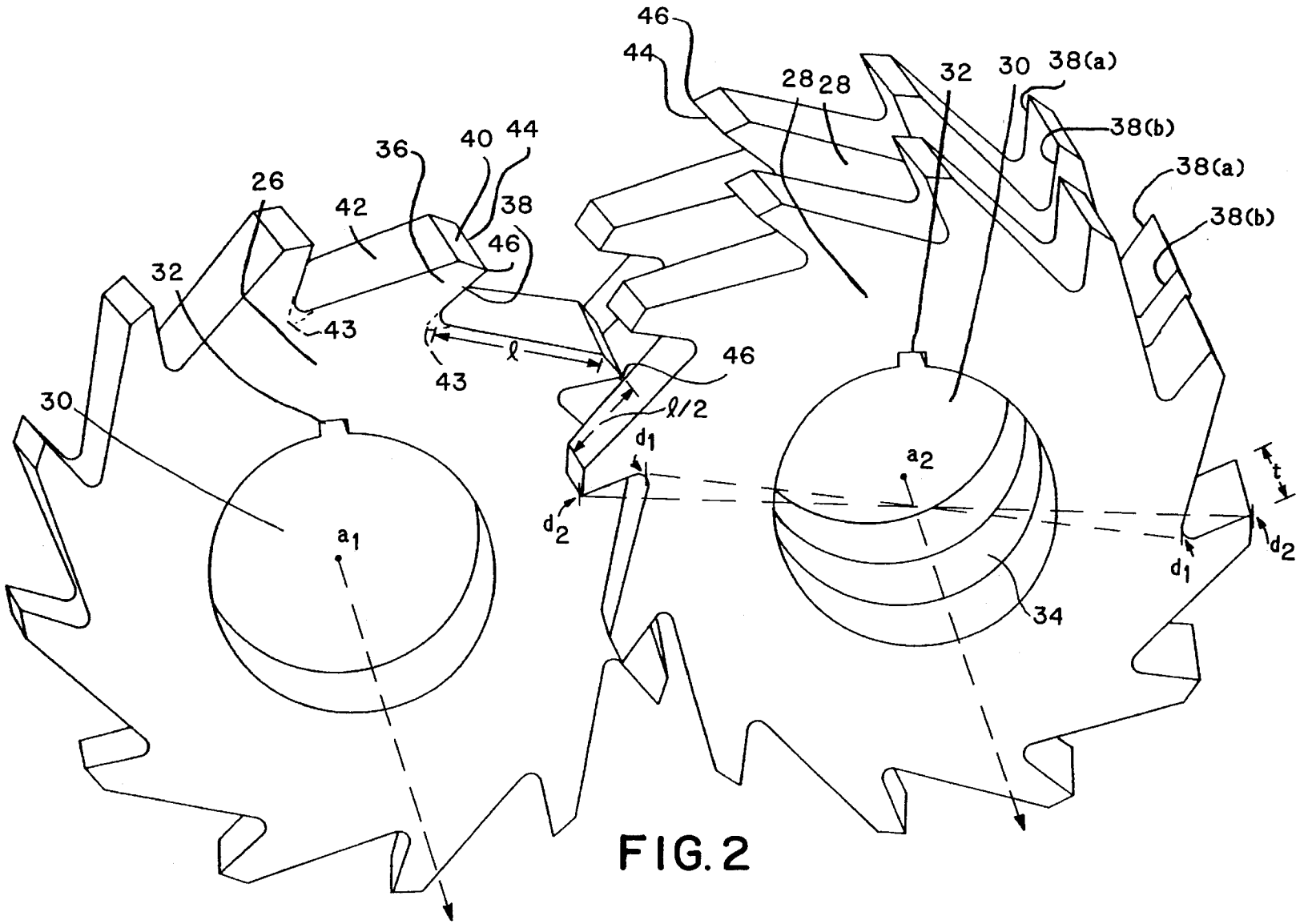
FIG. 2 depicts a cutting wheel on one shaft passing between two cutting wheels on the opposite shaft in accordance with the present invention.

As embodied herein, and referring to FIGS. 1 and 2, a first plurality of cutting wheels 26 is positioned on first shaft 22. A second plurality of cutting wheels 28 is positioned on second shaft 24. Preferably, all of the cutting wheels 26, 28, are milled from a bar of D2 tool steel and heat treated to increase hardness, having a preferred core diameter $d_1$ of approximately 4.8 inches, a largest diameter $d_2$ of approximately 6.0 inches, and a thickness t of approximately ½ inch. Each cutting wheel 26, 28 has a central aperture 30, having a diameter slightly greater than the diameter of the corresponding shaft 22, 24. A ¼ inch wide by ⅛ inch deep keyway 32 is cut into the central aperture 30 of each cutting wheel, configured to receive a portion of keystock 25 projecting from its mounted position on the respective shaft. A spacer ring 34, preferably manufactured of S7 tool steel having a thickness of approximately ½ inch, an outer diameter of approximately 3.9 inches, a central aperture, and a ¼ inch wide by ⅛ inch deep keyway, is provided between each cutting wheel 26 in the first plurality of cutting wheels on first shaft 22, and between each cutting wheel 28 in the second plurality of cutting wheels on second shaft 24.

The cutting wheels and spacers are mounted with each cutting wheel 26 on shaft 22 opposing a spacer ring 34 on shaft 24, and each cutting wheel 28 on shaft 24 opposing a spacer ring 34 on shaft 22. Moreover, each cutting wheel in each plurality on each shaft is interleaved and overlapping with two cutting wheels in the other plurality on the other shaft, as partially depicted in FIG. 2. The cutting wheels 26, 28 and spacer rings 34, are fixed in position on the respective shafts 22, 24, by the use of locking rings (not shown) positioned on the ends of each shaft.

In accordance with the present invention, each cutting wheel in the first and second plurality of cutting wheels includes a plurality of teeth, each tooth including a leading surface and first and second trailing surfaces. The second trailing surface has a preselected length. Each leading surface and first trailing surface meet to define a cutting edge, each cutting edge being skewed with respect to its respective axis to define a cutting point.

As embodied herein, and referring to FIGS. 1 and 2, each cutting wheel 26, 28 includes a plurality of teeth 36 at its outer periphery, preferably at least twelve teeth on each cutting wheel. Each tooth 36 is provided with a leading surface 38, a first trailing surface 40, and a second trailing surface 42, which has, in the preferred embodiment, an imaginary intersection 43 with the leading surface 38 of the next succeeding tooth 36. Each second trailing surface 42 has a length "l", measured from the junction of the first and second trailing surfaces 40, 42 to intersection 43, allowing for the variances in the precise position of intersection 43 created by the milling process. Length "l" is preferably 1½ inches. Each leading surface 38 and first trailing surface 40 intersect along a line which leads both the leading surface 38 and first trailing surface 40, hence defining a cutting edge 44. Moreover, each tooth 36 is milled so that the leading and trailing surfaces 38, 40, 42, and hence each cutting edge 44, are skewed with respect to the respective axis $a_1$, $a_2$, of the respective shaft 22, 24. The skew angle between each surface and cutting edge 44, and the respective axis, is preferably between 10° and 20°, with approximately 15° providing the best result. The skew of each cutting edge 44 with respect to its axis B defines a cutting point 46.

Figure 3:
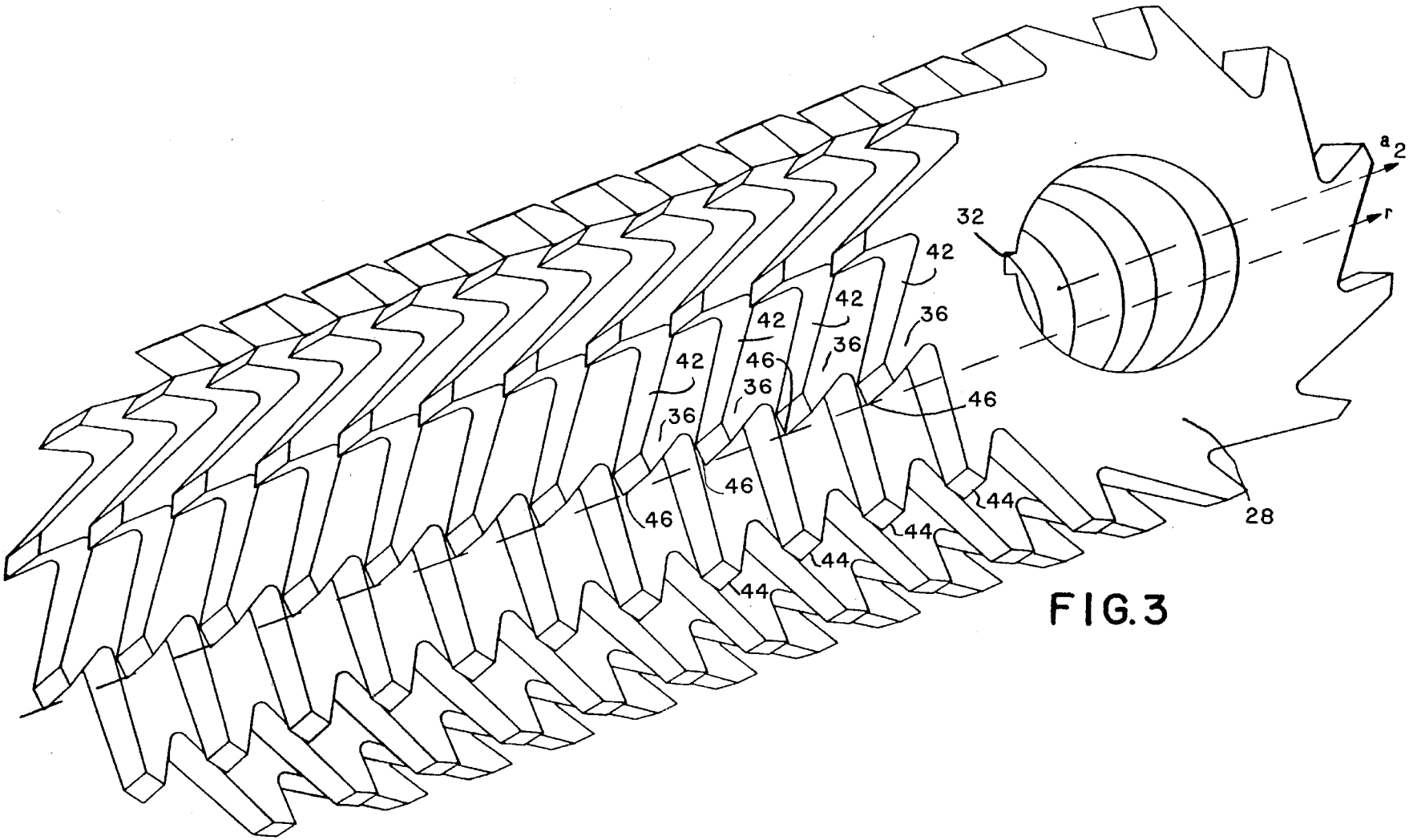
FIG. 3 is a perspective view of a plurality of cutting wheels as they are to be positioned on one of the rotating shafts in accordance with the present invention.

Preferably, each cutting wheel 26, 28 is positioned on its respective shaft 22, 24, with keystock 25 projecting into keyway 32, such that successive cutting wheels in each plurality are not staggered. Instead, referring to FIG. 3, each cutting point 46 on each wheel in each respective plurality of cutting wheels (depicting cutting wheels 28 in FIG. 3), aligns with corresponding cutting points 46 on adjacent cutting wheels in a line "r" that is parallel and coplanar to the respective axis ($a_2$ in FIG. 3).

In accordance with the present invention, each cutting wheel is rotatable with its respective shaft such that each cutting point leads both the leading surface and the cutting edge of the respective tooth.

As embodied herein, and referring to FIGS. 1 and 2, each cutting wheel 26, 28 is positioned on its respective shaft 22, 24, by the presence of keystock 25 projecting into each keyway 32, so that each cutting wheel 26, 28 rotates with its respective shaft. Moreover, with reference to FIG. 2, as each shaft rotates, each cutting point 46 leads its respective tooth 36, leading both the leading surface 38 and the cutting edge 44. Additionally, referring to FIG. 2, the skewed aspect of each tooth 36 results in each leading surface 38 having a leading edge 38(*a*) and a trailing edge 38(*b*).

In accordance with the invention, each cutting wheel is positioned on its respective shaft such that each cutting point on each tooth of each cutting wheel passes two second trailing surfaces of corresponding teeth of cutting wheels on the other shaft disposed on either side of the respective cutting wheel approximately midway along the preselected lengths of the two second trailing surfaces.

As embodied herein, and referring to FIG. 2, as tooth 36 of each cutting wheel (cutting wheel 26 in FIG. 2), rotates toward the cutting wheels on the other shaft (cutting wheels 28 in FIG. 2), its cutting point 46 will pass between two second trailing surfaces 42 on either side thereof. Specifically, each cutting point 46 will pass the two second trailing surfaces 42 on either side at a particular position, which is approximately midway along the preselected lengths of the second trailing surfaces, or "½" In operation, the plastic or aluminum container material being densified will be pressed against the two second trailing surfaces 42 as the cutting point 46 punches through the material. In this manner, each cutting point 46 and associated two second trailing surfaces 42 function substantially as a "punch and die." The effectiveness of this arrangement will be described in greater detail below.

Figure 4A:
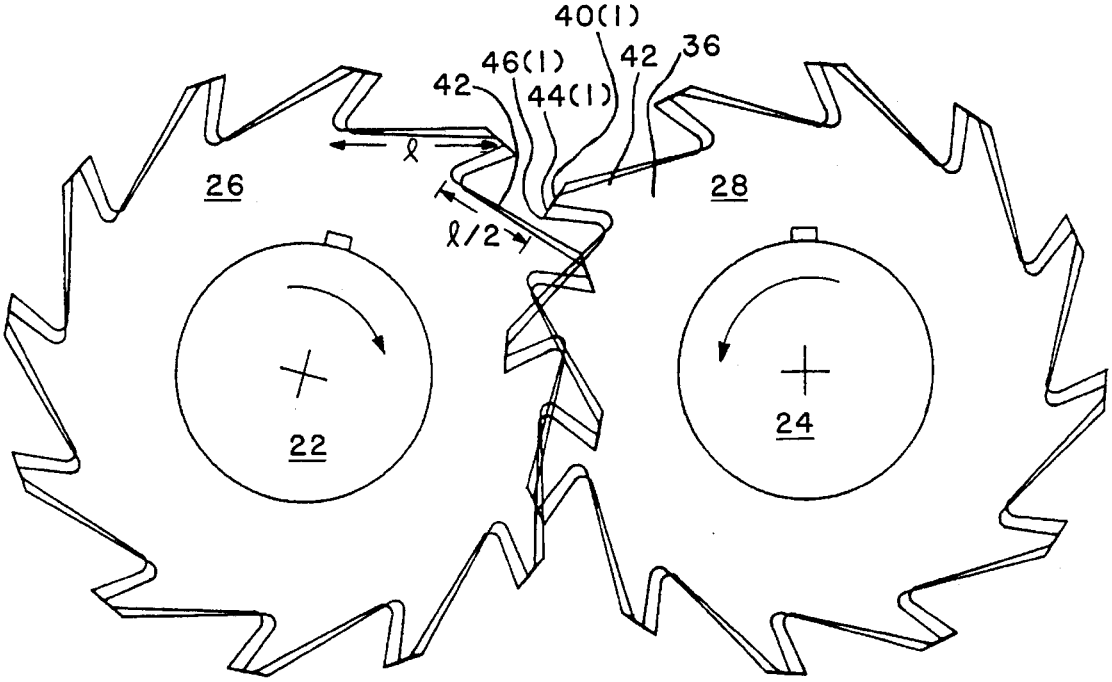
FIG. 4A is a schematic view depicting a first sequential position of interleaved cutting wheels on opposite shafts in accordance with the present invention.
Figure 4B:
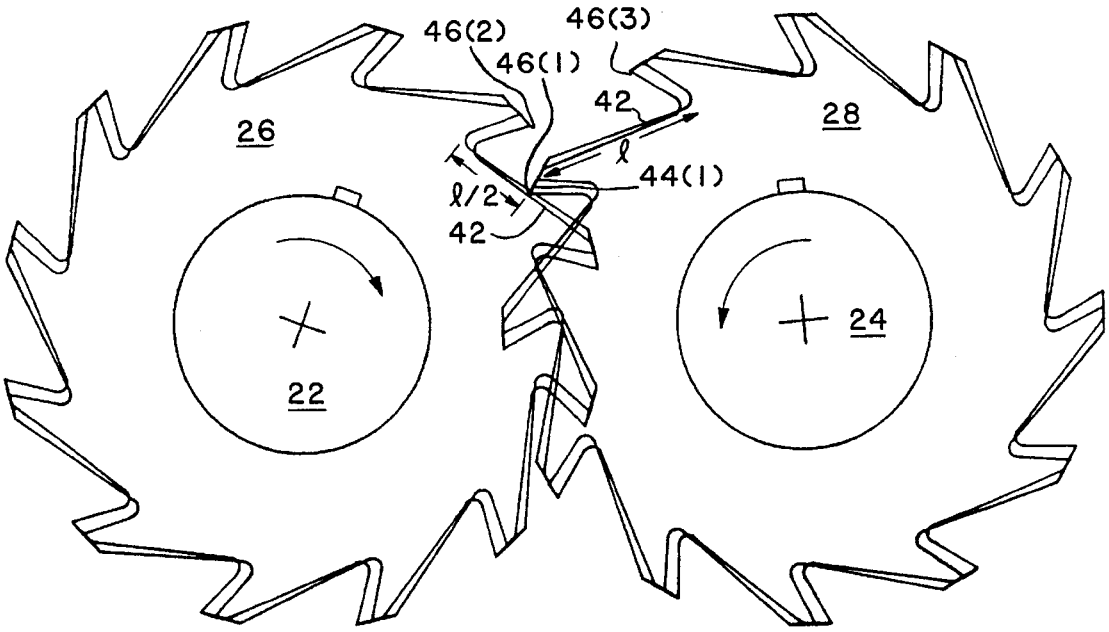
FIG. 4B is a schematic view depicting a second sequential position of interleaved cutting wheels on opposite shafts in accordance with the present invention.
Figure 4C:
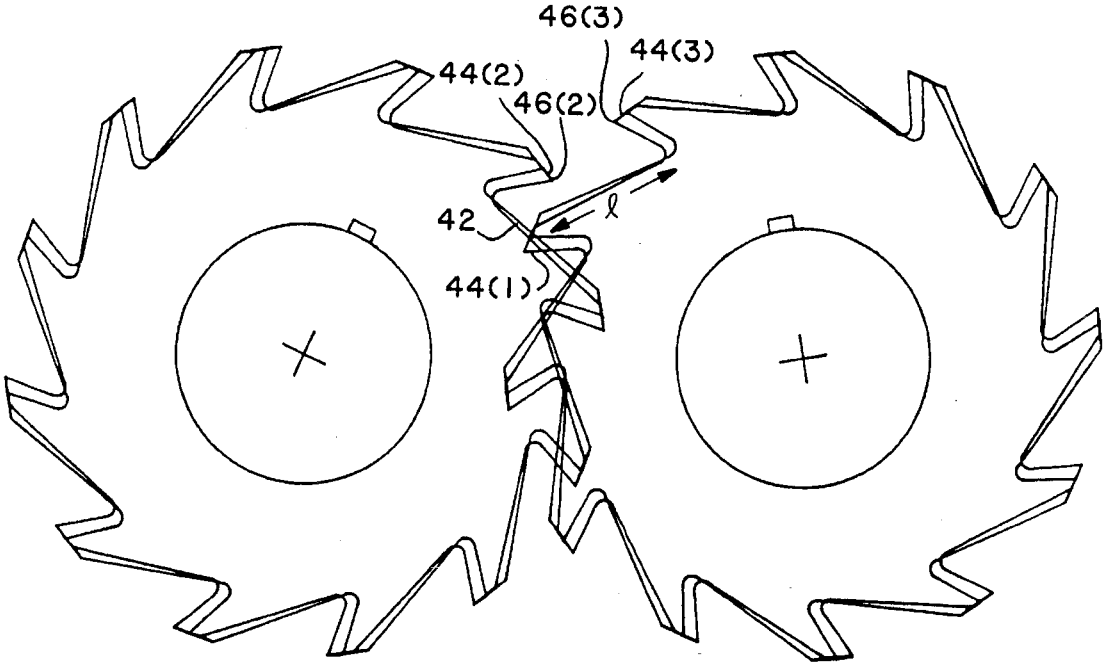
FIG. 4C is a schematic view depicting a third sequential position of interleaved cutting wheels on opposite shafts in accordance with the present invention.
Figure 4D:
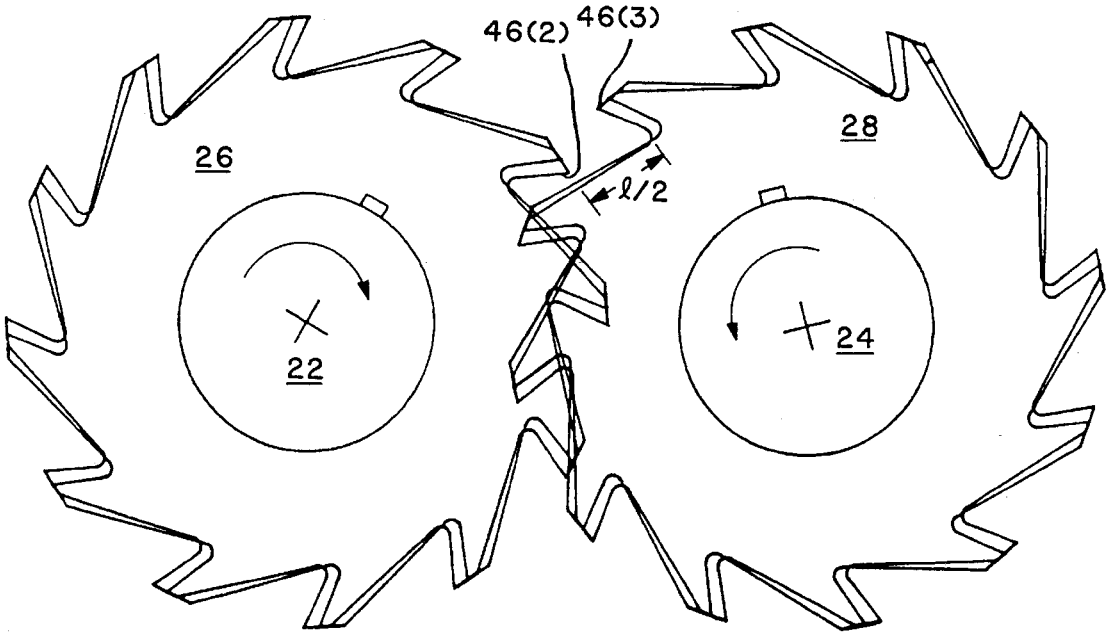
FIG. 4D is a schematic view depicting a fourth sequential position of interleaved cutting wheels on opposite shafts in accordance with the present invention.
Figure 4E:
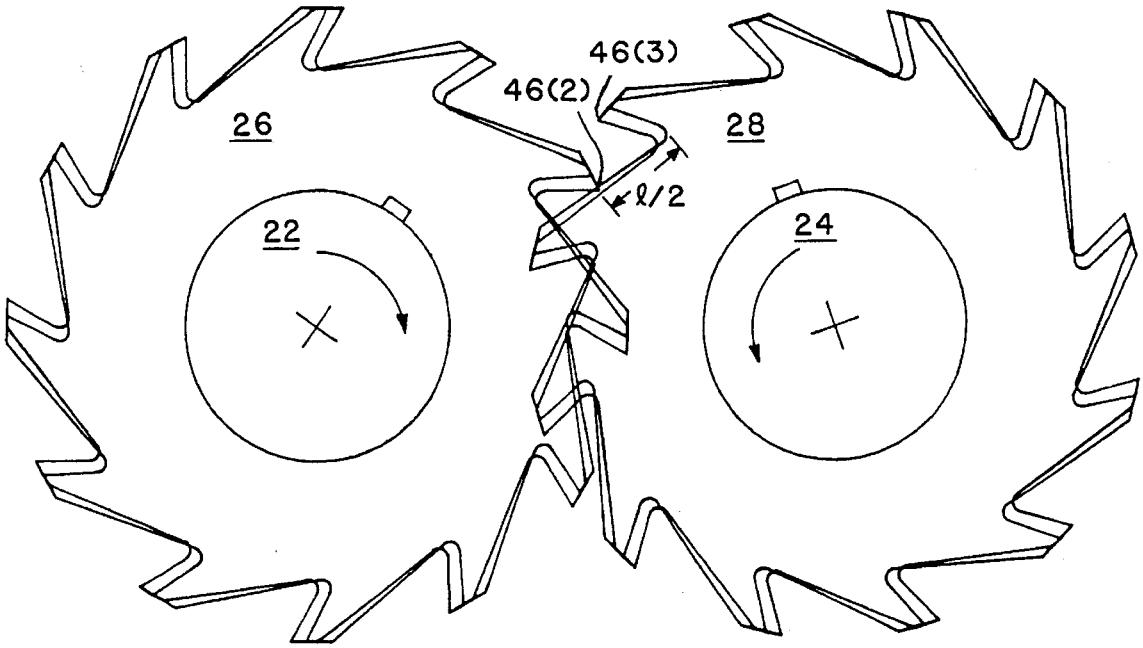
FIG. 4E is a schematic view depicting a fifth sequential position of interleaved cutting wheels on opposite shafts in accordance with the present invention.
Figure 4F:
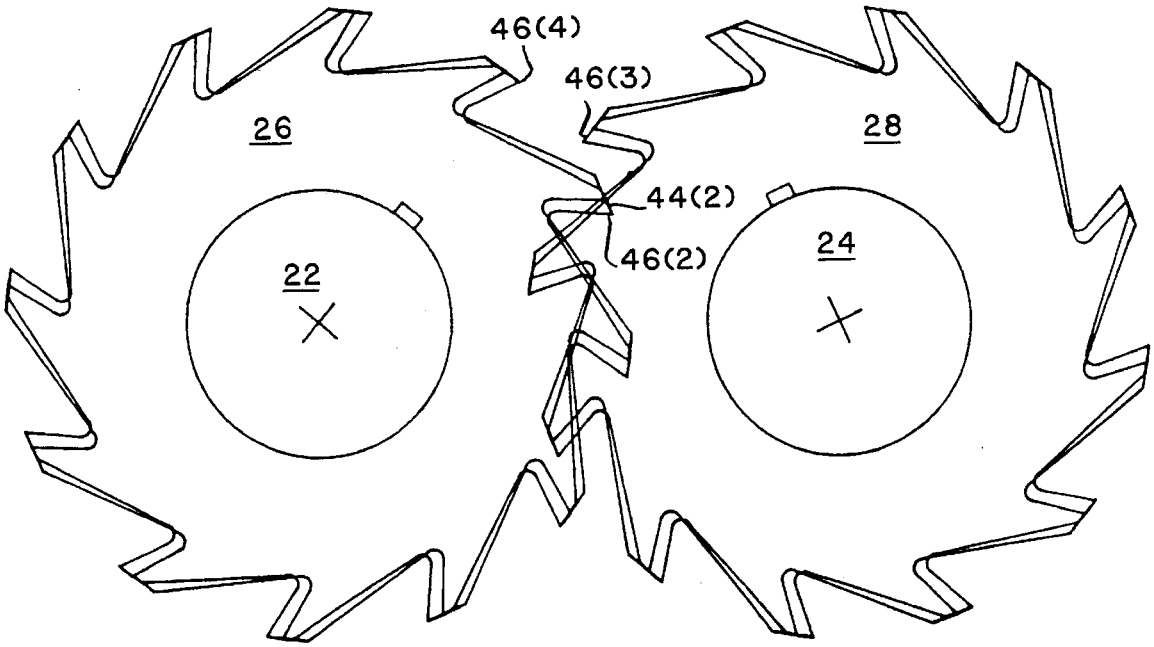
FIG. 4F is a schematic view depicting a sixth sequential position of interleaved cutting wheels on opposite shafts in accordance with the present invention.
Figure 4G:
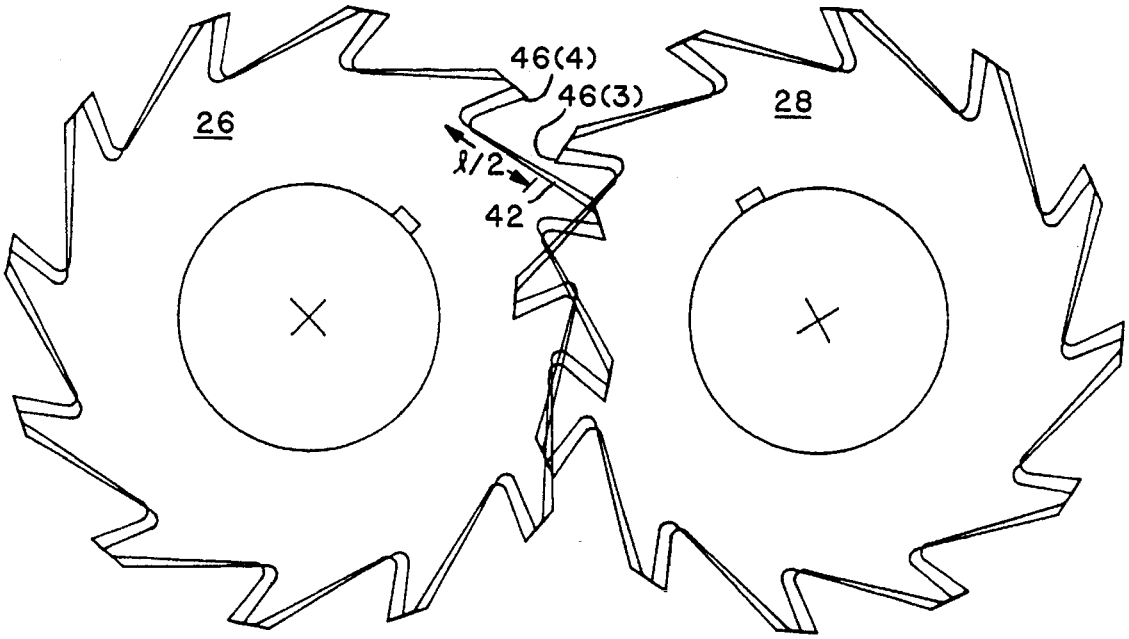
FIG. 4G is a schematic view depicting a seventh sequential position of interleaved cutting wheels on opposite shafts in accordance with the present invention.

The feature of the invention described above can be more easily understood by a review of FIGS. 4A–4G, which depict a portion of the two pluralities of cutting wheels 26, 28 in a timed rotational sequence. Referring to FIG. 4A, as wheels 26 and 28 rotate in opposite directions, one cutting point 46 on cutting wheel 28 (designated 46(1) for ease of explanation) prepares to pass between two second trailing surfaces 42 of teeth on cutting wheels 26 on either side thereof (only one cutting wheel 26 is shown in FIG. 4A). Each second trailing surface 42 has a length "1". Referring now to FIG. 4B, cutting point 46(1) passes between the two adjacent second trailing surfaces 42 at a position approximately midway along the length, designated "½". Referring to FIG. 4C, cutting edge 44(1) following cutting point 46(1) passes between the second trailing surfaces 42 of the teeth of cutting wheels 26 on either side, although at a position beyond the "½" midway position. Referring to FIG. 4D, cutting point 46(2) of the next corresponding tooth on cutting wheel 26 approaches second trailing surfaces 42 of teeth on two cutting wheels 28 on either side thereof. Referring to FIG. 4E, cutting point 46(2) on cutting wheel 26 passes between two second trailing surfaces 42 of teeth on two cutting wheels 28, at a position midway along the preselected lengths, again designated "½". Referring to FIG. 4F, cutting edge 44(2) on cutting wheel 26 passes the second trailing surfaces 42 on cutting wheel 28. Referring to FIG. 4G, yet another cutting point 46(3) on the next tooth on cutting wheel 28 approaches two second trailing surfaces 42 of teeth on cutting wheels 26. This pattern occurs repeatedly as the shafts and cutting wheels continue to rotate.

Figure 5:
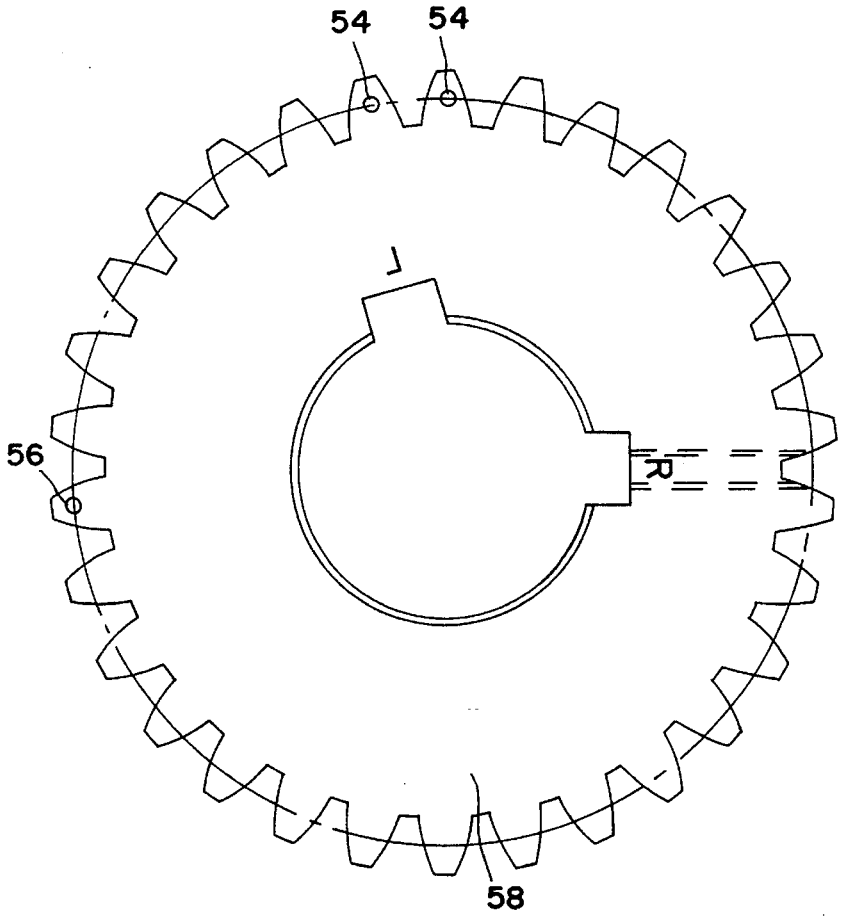
FIG. 5 is a view of a template for placing position timing marks on gears used to drive the shafts, in order to time rotation of the shafts in accordance with the present invention.

It is preferable that the cutting wheels 26, 28 be positioned on opposing shafts 22, 24 at the time of assembly, so that the positional relationship of cutting points 46 and second trailing surfaces 42 can be properly timed to occur repeatedly. In order to establish this relationship quickly and efficiently, gears 50(1), and 50(2) which serve to interlink shafts 22, 24 together, and further serve to link one of the shafts with a driving motor (described below), are initially meshed together in a preselected position by use of timing marks. Referring to FIG. 1, gear 50(1) connected to shaft 24, has two "right hand" timing marks 54 on adjacent teeth, whereas gear 50(2) connected to shaft 22 has a single "left hand" timing mark 56 on one tooth. The tooth of gear 50(2) with the left hand timing mark 56 is positioned between the adjacent teeth of gear 50(1) with the right hand timing marks 54. Preferably, referring to FIG. 5, the timing marks 54, 56 are positioned at the proper position on each gear through use of a gear template 58. Furthermore, by using the template 58, each gear is cut so that it can be used either as right-hand gear 50(1) or left-hand gear 50(2). The gear manufacturer uses one side of template 58 to prepare the right hand side of gear 50(1), which is designated by stamping an "R" on that side of the gear, cutting a keyway, and positioning timing marks 54 as shown. The gear manufacturer then flips the gear over to prepare the left hand side of the gear 50(2), which is designated by stamping an "L" on that side of the gear, cutting a keyway, and positioning timing mark 56 as shown. Gears with right hand sides 50(1) and left hand sides 50(2) are prepared using template 58, and then are fixed to the appropriate shafts 22, 24. The shafts 22, 24 and cutting wheels 26, 28 are rotated until timing marks 54, 56 line up in the position depicted in FIG. 1, and the assembly is then tightened into place. The cutting points 46 and second trailing surfaces 42 of teeth 36 will henceforth cross each other repeatedly in the desired manner.

In accordance with the present invention, a container cutting assembly further comprises a third rotatable shaft positioned generally above one of the first and second shafts. A pliable paddle projects from the third shaft.

As embodied herein, and referring to FIG. 1, third rotatable shaft 60 is rotatably supported in housing 21 generally above first shaft 22, although it is to be understood that third shaft 60 could also be positioned above second shaft 24 with appropriate modification to housing 21. As broadly embodied in FIG. 1, third shaft 60 is linked to first shaft 22 via gear 62 fixed to first shaft 22, gear 64 attached to third shaft 60, and chain 66 linking gears 62 and 64 together. Pliable paddle 68 projects from the length of third shaft 60. Preferably, paddle 68 is a planar piece of multiple-layer rubber with nylon reinforcement, and preferably extends approximately 3½ inches from third shaft 60, and shorter than the distance from third shaft 60 to the periphery of cutting wheels 26 on first shaft 22. The function of pliable paddle 68 will be discussed below. As embodied in FIG. 1, third shaft 62 and paddle 68 rotate in the same direction as first shaft 22 and cutting wheels 26. However, because of the gearing ratio between gear 62 and gear 64, the tangential velocity of paddle 68 is slower than the tangential velocity of cutting wheels 26.

In accordance with the invention, the housing includes first and second side walls containing apertures, the first and second shafts projecting through the apertures, and first and second deflectors parallel to and approximate the side walls. The first deflector has an arcuate lower portion at least partially encircling one cutting wheel on the first shaft. The second deflect or has an arcuate lower portion at least partially encircling one cutting wheel on the second shaft.

Figure 6:
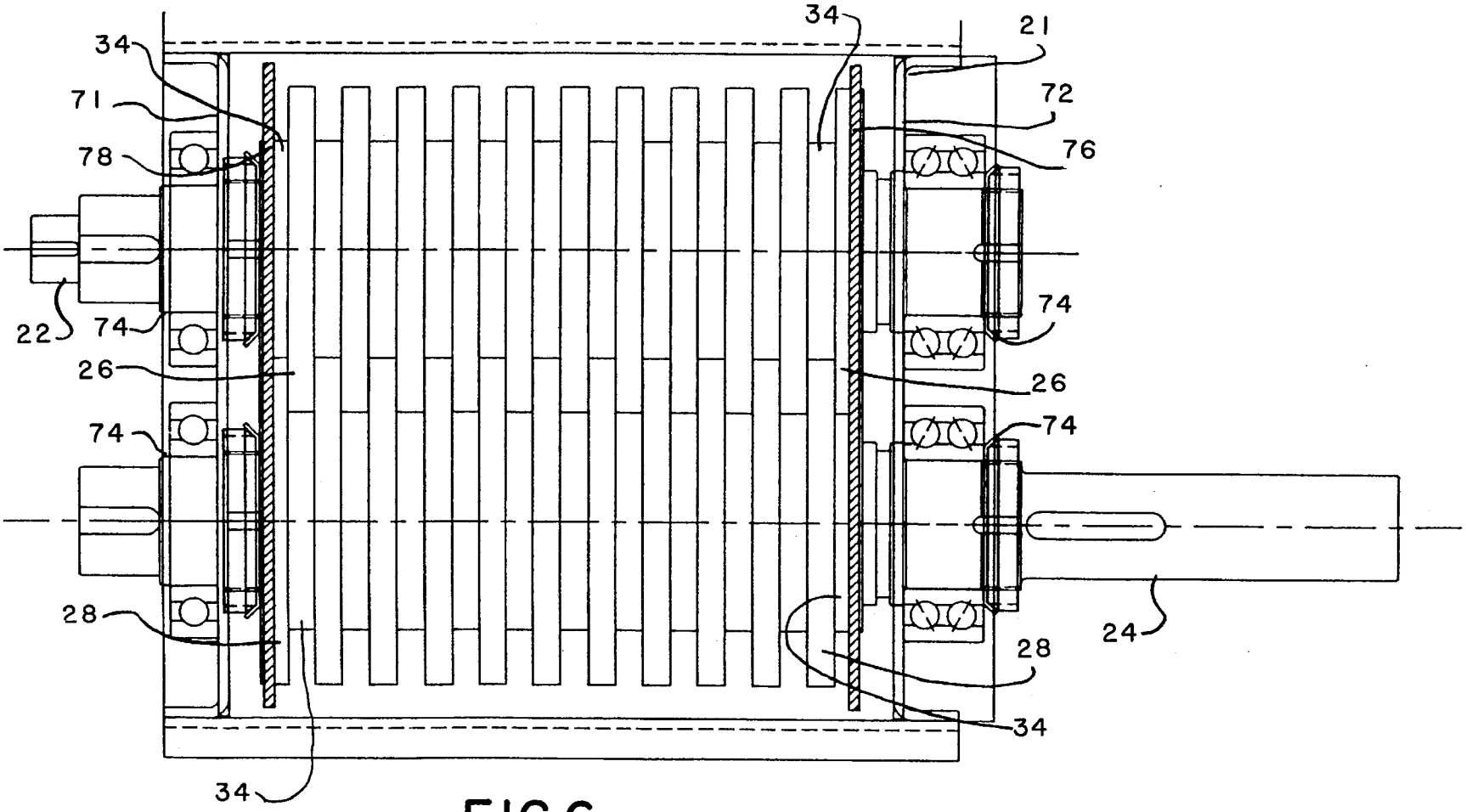
FIG. 6 is a partial top view of a container cutting assembly, depicting first and second deflectors in accordance with the invention.

As embodied herein, and referring to FIG. 6, housing 21 includes side walls 71, 72. A plurality of apertures 74 are provided in side walls 71, 72, through which shafts 22, 24, 60 (not shown) project and are rotatably supported. A first deflector 76 and a second deflector 78, each preferably a metal sheet approximately ⅛ inch thick, project downward into housing 21, parallel to and spaced slightly from side walls 71, 72 respectively.

Referring to FIG. 1, first deflector 76 has an arcuate lower edge 80 which partially encircles the outer periphery of the endmost cutting wheel 26 on first shaft 22. First deflector 76 has a second arcuate lower edge 82 which partially encircles an outer periphery of an endmost opposing spacer ring 34 on second shaft 24. Likewise, second deflector 78 has an arcuate lower edge 84 which partially encircles an outer periphery of an endmost cutting wheel 28 on second shaft 24, and a second arcuate lower edge 86 which partially encircles an outer periphery of an endmost opposing spacer ring 34 on first shaft 22. The function of the arcuate lower edge portions 84, 86 will be discussed below.

In accordance with the invention, the container cutting assembly is provided with a driver including a motor for driving the shafts and a suspension system provided between the driver and the shafts for absorbing and releasing excess energy applied to the assembly.

Figure 7:
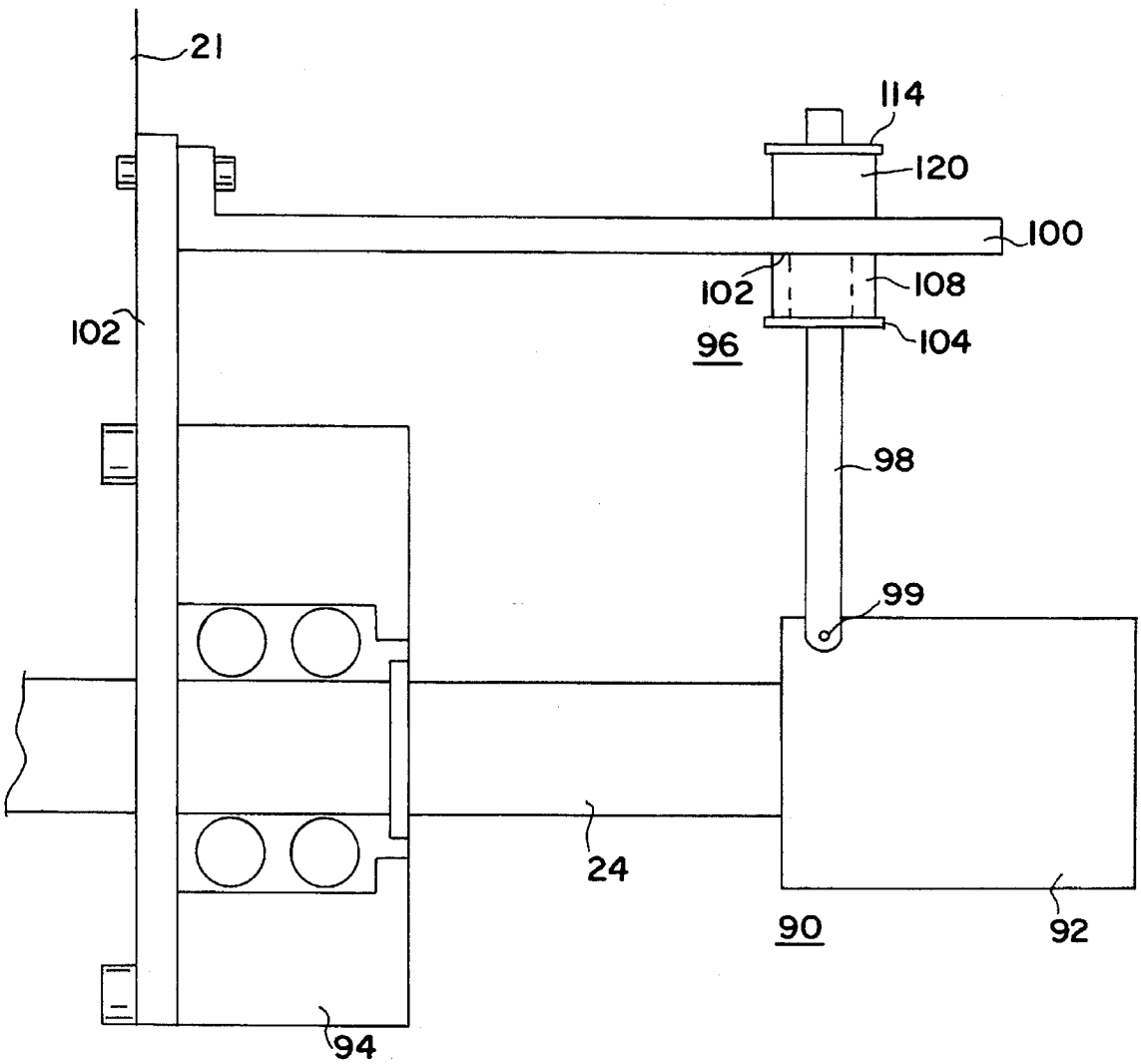
FIG. 7 is a partial view of a container cutting assembly depicting a position of a spring-loaded suspension system in accordance with the invention.

As embodied herein and referring to FIG. 7, a driver 90 includes a motor, depicted broadly as 92, preferably a five horsepower motor, and requisite gearing (not shown) to drive the shafts. As embodied herein, driver 90 is geared to drive second shaft 24 directly, and via the gearing and chain described earlier, also drive shafts 22 and 60. As broadly embodied in FIG. 7, a bearing system 94, preferably a housing with ball bearings, surrounds shaft 24 proximate housing 21. As further broadly embodied in FIG. 7, a suspension system 96 is provided between driver 90 and bearing system 94.

In accordance with the invention, the suspension system comprises a frame member connected to the first and second shaft, a columnar member connected at one end to the driver, the columnar member penetrating and movable relative to the frame member, a compression member attached to the columnar member proximate a side of the frame member nearest the driver, and a means for absorbing and releasing energy positioned between the compression member and the frame member.

Figure 8:
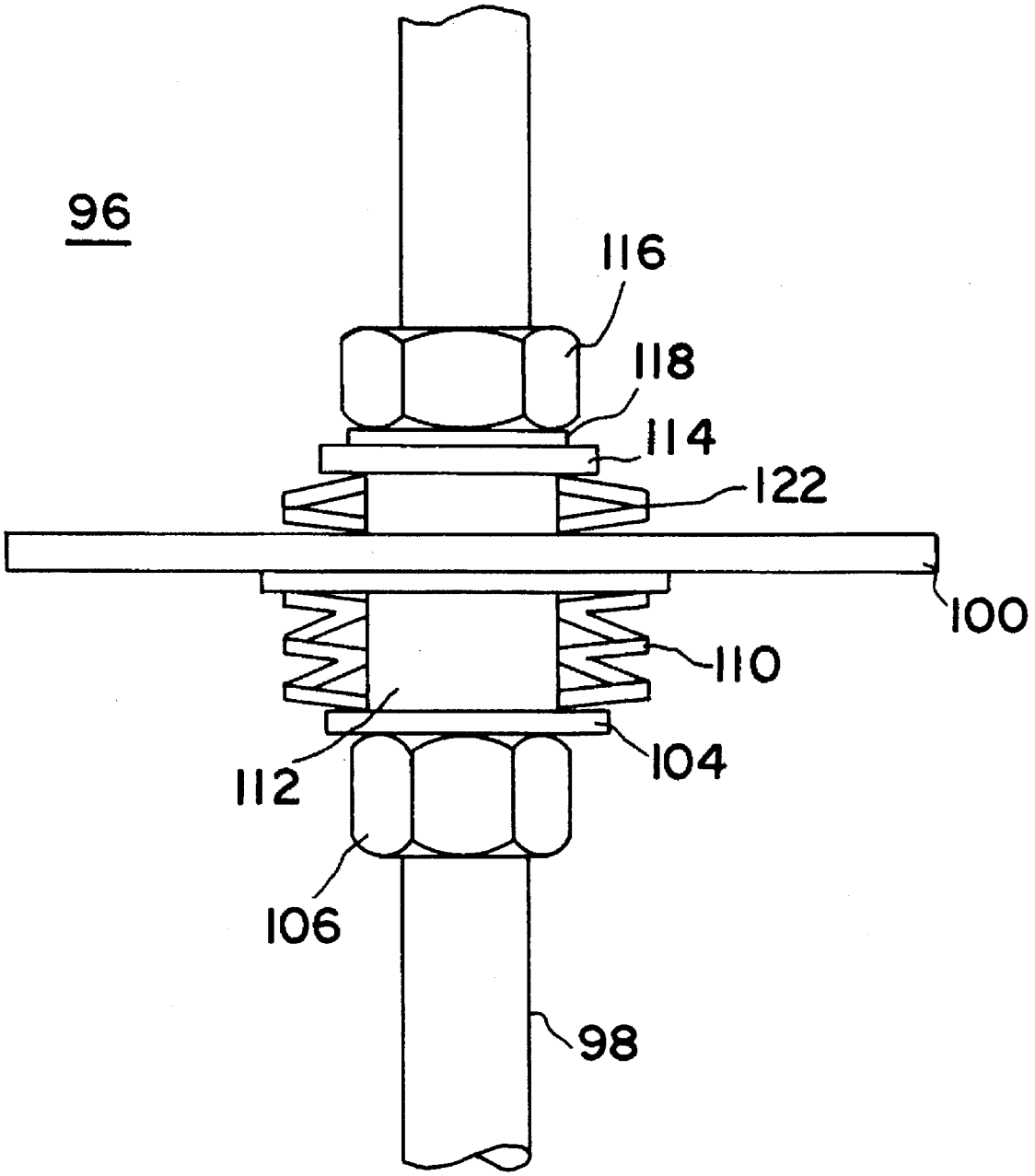
FIG. 8 is a partial side view of the spring-loaded suspension system of FIG. 7.

As broadly embodied herein, and referring to FIGS. 7 and 8, suspension system 96 includes a columnar member 98 fixed at one end 99 to the casing of motor 92. Preferably, as shown in FIG. 8, columnar member 98 is a threaded bolt. A generally planar frame member 100, connected via support 102 to bearing system 94, projects over motor 92. Frame member 100 is penetrated by an aperture 102. Columnar member 98 projects through aperture 102, so that columnar member 98 can move relative to frame member 100. Compression member 104, preferably a ⅝ SAE washer, is mounted on columnar member 98, preferably resting on a ⅝-11 threaded nut 106, on the side of frame member 100 facing motor 92. Means for absorbing and releasing energy are provided between the compression member 104 and frame member 100. As broadly embodied herein, absorbing and releasing means 108 may include a spring. A number of conventional coil springs, leaf springs, and similar devices can be used, with disc springs being preferred. Referring to FIG. 8, a stack of five disc springs 110 are provided between compression member 104 and frame member 100. Additionally, it is preferred that a spacer 112 be provided between disc springs 110 and columnar member 98, to prevent the springs from binding in the threads. It is also preferred that nut 106 be adjusted sufficiently to place a slight pre-compression on disc springs 110 when the suspension system is first assembled.

In accordance with the invention, the suspension system further comprises a second compression member attached to the columnar member proximate a side of the frame member facing away from the driver, and a second means for absorbing and releasing energy positioned between the second compression member and the frame member.

As broadly embodied herein, and referring to FIGS. 7 and 8, compression member 114, preferably a ⅝ SAE washer, rests against ⅝-11 nut 116 and ⅝ split lock 118, proximate a side of frame member 100 facing away from motor 92. A second means for absorbing and releasing energy is provided between second compression member 114 and frame member 100. As broadly embodied herein, second absorbing and releasing means 120 may include a spring. A number of conventional coil springs, leaf springs, and similar devices can be used, with disc springs being preferred. Referring to FIG. 8, a stack of two disc springs 122 are provided between second compression member 114 and frame member 100, with spacer 112 between the disc springs 122 and the threads on bolt 98. Nut 116 should be tightened sufficiently during assembly to place a slight pre-compression on disc springs 122.

In accordance with the invention, the container cutting assembly is provided with strippers mounted on inner walls of the housing. Each stripper has finger portions extending between the cutting wheels on the respective first and second shaft.

As embodied herein, and referring to FIG. 1, a stripper 130 is attached to inner walls of housing 21 proximate shafts 22, 24. Each stripper 130 includes a plurality of substantially flat metal finger portions 132 which extend between cutting wheels 26 on shaft 22, and between cutting wheels 28 on shaft 24, ending proximate the outer periphery of spacer rings 34. Although strippers 130 having flat rigid fingers 132 are shown, it is to be understood that conventional combers can also be interspersed between the cutting wheels, as is known in the art.

A container-cutting assembly in accordance with the present invention operates as follows. Referring to FIG. 1, a container of material "M" (which may be aluminum, polyethylene, PVC, PET, or the like) is inserted into container cutting assembly 20. Due to the position of the third shaft 60 and pliable paddle 68 generally above first shaft 22, the material "M" enters the assembly at an angle via opening 140 near a side corner of housing 21. Angled stanchion 142 directs material "M" in the direction of the cutting wheels. Paddle 68 may contact, or "spank", material "M", but does not "grip" the material. Instead, paddle 68 merely directs material "M" in the direction of the cutting wheels. Occasionally, a container may bob away from the cutting wheels. In this case, paddle 68 will again "spank" the container back into the direction of the cutting wheels.

Figure 9:
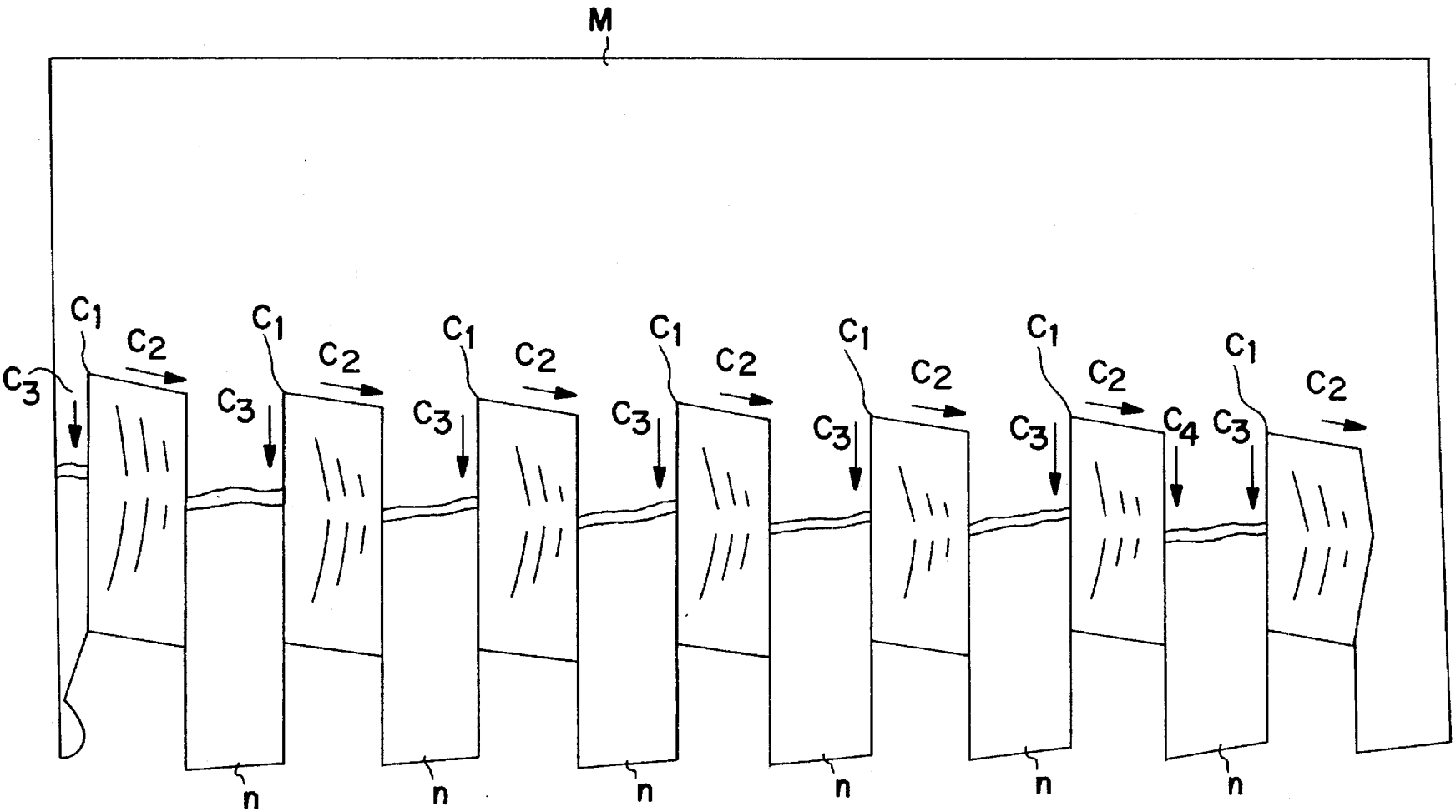
FIG. 9 is a partial view of a section of container material cut in accordance with the present invention.

Material "M" then is gripped by the cutting wheels and cutting commences. Material "M" passes into the container cutting assembly 20 and is supported on a row of second trailing surfaces 42. Such a row of second trailing surfaces 42 can be seen in FIG. 3. This row of second trailing surfaces 42 serves as a "die." Next, because of the skew of cutting edges 44, an aligned row of cutting points 46 strikes the material "M" simultaneously between each two second trailing surfaces 42, creating a "punch" effect. Referring now to FIG. 9, cutting points 42 puncture or "punch" through the material "M" at points "$C_1$". This "punch" effect is due in part to the fact that the striking force of each tooth is focused into a point. In addition, because the cutting points pass the second trailing surfaces at the "½" midway position, the material "M" is provided maximum support by the "die." The "punch and die" effect sought by the device is thereby maximized.

Next, as the row of cutting edges 44 begin to pass the row of second trailing surfaces 42, a series of angled horizontal cuts "$C_2$" begins, as shown in FIG. 9. Almost simultaneously, a row of ,, leading side edges 38(*a*) of the skewed leading surfaces 38 also began passing second trailing surfaces 42, beginning a series of vertical cuts $C_3$. After the cutting edges 44 pass the row of second trailing surfaces 42, a row of trailing side edges 38(*b*) of the skewed leading surfaces 38 pass the second trailing surfaces 42, starting another series of vertical cuts $C_4$, which are parallel to vertical cuts $C_3$. Once the series of vertical cuts $C_4$is complete, a row of chips "n" are completely severed from material "M", and drop downward.

The chips "n" are indeed cut from the material "M", rather than bent, pulled, and shredded. Each chip "n" has the following dimensions: a length substantially equal to the length of a second trailing surface, and a width substantially equal to the width of a tooth. The chips "n" typically are uniformly small enough to be removed with a pneumatic removal device. Moreover, because the container cutting assembly of the present invention actually cuts the material, rather than pulling and tearing it, the device can be used to cut both plastic and aluminum without adjustment by the operator.

It will be understood that this process recurs repeatedly. Furthermore, in the case where material "M" is a container such as a plastic bottle or aluminum can, it is understood that the container will be compressed into a double-walled material, and that this cutting process occurs on both walls of the material.

At the sides of the container cutting assembly, where strips of material tended to wrap around the shafts in previous shredders, deflectors 76, 78, including the arcuate lower edges 84, 86 partially encircling endmost cutting wheels and endmost spacer rings on opposing shafts, prevent chips "n" from wrapping around the shafts. All of the material is thus directed back between the cutting wheels. Meanwhile, fingers 100 of strippers 99 strip chips "n" away from spacer rings 34, preventing chips "n" from wrapping around the shafts.

If a large shock is suddenly placed on the system, due to insertion of an extremely hard plastic base cup, or due to deliberate insertion of a foreign object, the sudden excess energy transferred back along shafts 22, 24 to motor 92 causes columnar member 98 to move in a first direction toward frame member 100. Compression member 104 compresses disc springs 110 against frame member 100, the disc springs thereby absorbing the excess energy applied to the system by the shock. The disc springs 110 subsequently expand, releasing the energy to return it to the motor 92 and shafts 22, 24. In the preferred embodiment depicted in FIGS. 7 and 8, this movement of columnar member 98 in a second direction away from the frame member 100, caused by the expansion of disc springs 110, is damped by compression of disc springs 122 between second compression member 114 and frame member 100. This compression of the second set of disc springs 122 prevents a Jolt being applied to the system by the release of the excess energy initially absorbed by disc springs 110.

Figure 10:
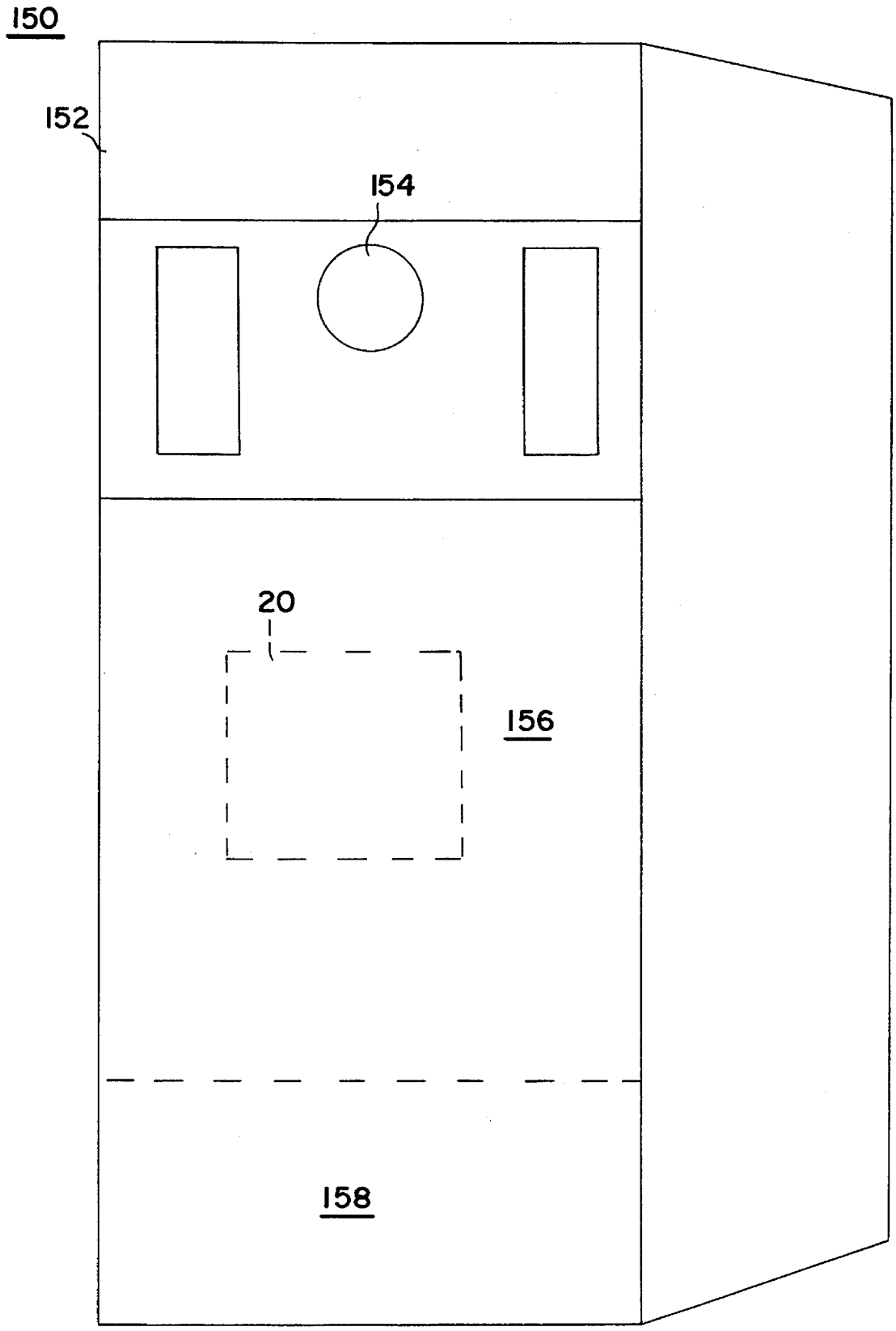
FIG. 10 is a view of the cabinet of a reverse vending machine in which the present invention can be used.
Figure 11:
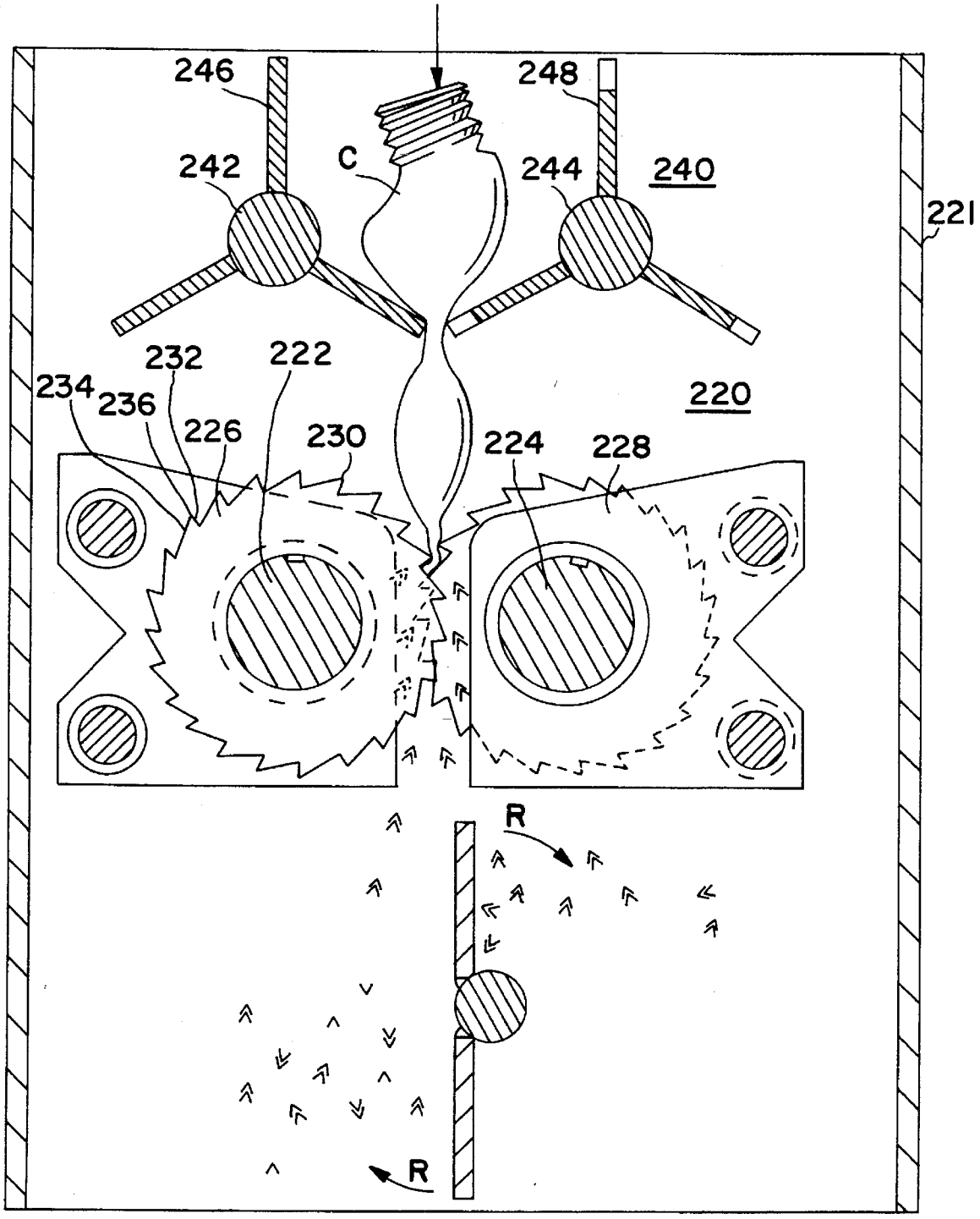
FIG.11 PRIOR ART
FIG. 11 is a partial side view of a prior container cutting assembly.
Figure 12:
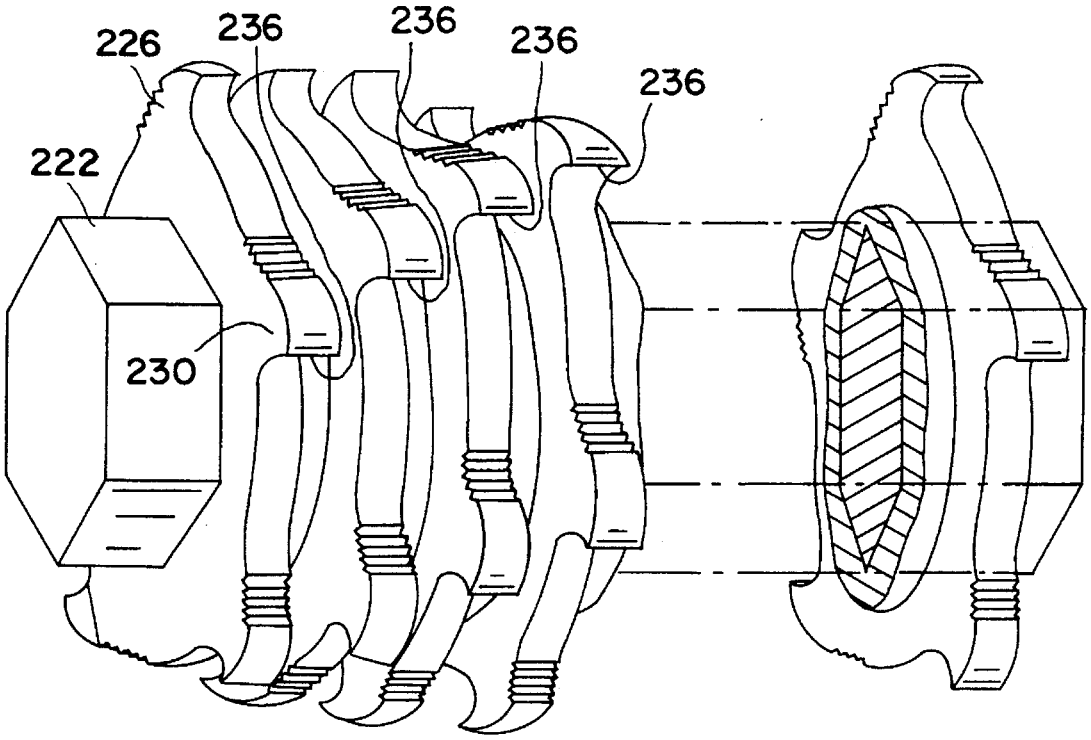
FIG. 12 PRIOR ART
FIG. 12 is a perspective view of the cutting wheels on one shaft in the prior related container cutting assembly of FIG. 11.
Figure 13:
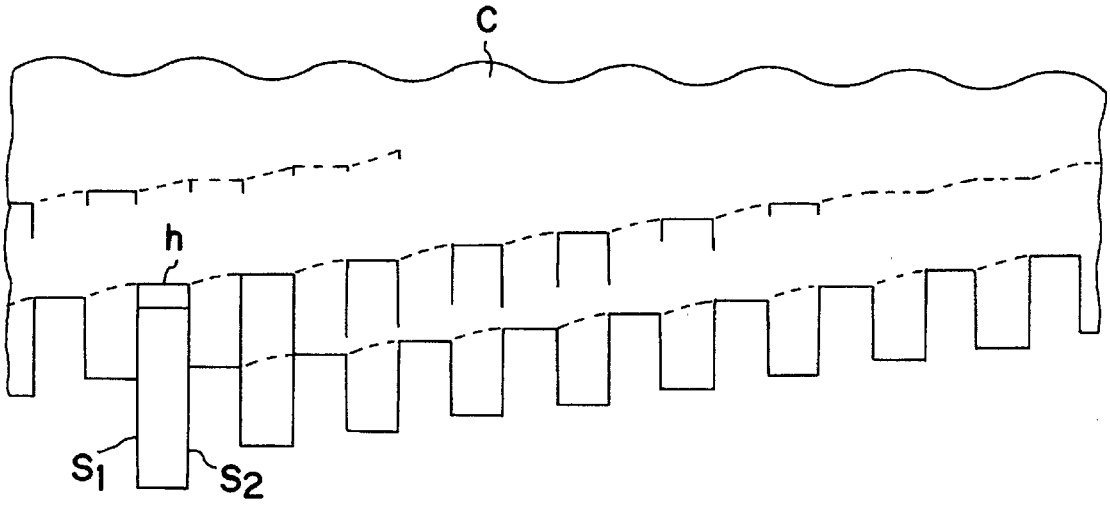
FIG. 13 PRIOR ART
FIG. 13 is a partial view of a section of container material cut by the prior container cutting assembly of FIGS. 11 and 12.

In accordance with the invention, a container cutting assembly can be installed in a reverse vending machine. As broadly embodied herein, and referring to FIG. 10, a reverse vending machine 150 includes a cabinet 152. An acceptance mechanism 154, which may be for example a door or chute, is provided in the cabinet. Container cutting assembly 20 of the present invention is mounted within the cabinet 150, to receive and densify plastic and aluminum containers which participate in the recycling program. It is understood that additional densification devices, including glass crushers, may also be provided in cabinet 152, but are not shown in FIG. 10. A refund device 156 is provided to issue a refund to the consumer in exchange for the container. Refunds may include cash, vouchers, coupons, or some combination of the above. Finally, storage bins 158 are provided to store the chips "n" of densified material. Although storage bins 158 are depicted in FIG. 10 inside the cabinet 152, it is understood that storage bins 158 may be provided external to the cabinet 152, with some means to pneumatically transfer the chips "n" to the external storage bins 158. Various configurations of reverse vending machines are well known, and therefore will not be discussed here in further detail. The container cutting assembly of the present invention is suitable for use with a number of reverse vending machines, and can be modified as necessary for a particular configuration.

It will be apparent to those skilled in the art that various modifications and variations can be made in the embodiment of the present invention described above without departing from the spirit or scope of the invention. Thus, it is intended that the present invention covers the modifications and variations of this invention provided they come within the scope of the appended claims and their equivalents.

We claim:

1. A container cutting assembly comprising:

first and second parallel counter-rotatable shafts defining respective first and second axes;

a first and second plurality of cutting wheels positioned on the first and second shafts, respectively, said first plurality of cutting wheels on said first shaft being interleaved with said second plurality of cutting wheels on said second shaft;

each cutting wheel in said first and second plurality of cutting wheels including a plurality of teeth, each tooth including a leading surface and first and second trailing surfaces, the second trailing surface having a preselected length, each leading surface and first trailing surface meeting to define a cutting edge, each cutting edge being skewed with respect to its respective axis to define a cutting point;

each cutting wheel being rotatable with its respective shaft such that each cutting point leads both the leading surface and the cutting edge of the respective tooth; and each cutting wheel being positioned on its respective shaft such that each cutting point on each tooth of each cutting wheel passes two second trailing surfaces of corresponding teeth of cutting wheels on the other shaft disposed on either side of the respective cutting wheel approximately midway along the preselected lengths of the two second trailing surfaces.

2. A container cutting assembly according to claim 1, wherein each tooth is skewed between 10° and 20° with respect to its respective axis.

3. A container cutting assembly according to claim 1 wherein the cutting points of the teeth on each cutting wheel of each respective plurality of cutting wheels align with one another defining a line parallel and coplanar to the respective axis.

4. A container cutting assembly according to claim 1, further comprising a housing with strippers mounted on inner walls of the housing, each stripper having finger portions extending between the cutting wheels on the respective first and second shaft.

5. A container cutting assembly comprising:

first and second parallel counter-rotatable shafts defining respective first and second axes;

a first and second plurality of cutting wheels positioned on the first and second shafts, respectively, said first plurality of cutting wheels on said first shaft being interleaved with said second plurality of cutting wheels on said each cutting wheel in said first and second plurality of cutting wheels including a plurality of teeth, each tooth including a leading surface and first and second trailing surfaces, the second trailing surface having a preselected length, each leading surface and first trailing surface meeting to define a cutting edge, each cutting edge being skewed with respect to its respective axis to define a cutting point;

each cutting wheel being rotatable with its respective shaft such that each cutting point leads both the leading surface and the cutting edge of the respective tooth;

each cutting wheel being positioned on its respective shaft such that each cutting point on each tooth of each cutting wheel passes two second trailing surfaces of corresponding teeth of cutting wheels on the other shaft disposed on either side of the respective cutting wheel approximately midway along the preselected length of the two second trailing surfaces; and a third rotatable shaft positioned generally above one of the first and second shafts, a pliable paddle projecting from the third shaft.

6. A container cutting assembly according to claim 5, wherein the cutting wheels on the first and second shafts rotate at a first tangential velocity, and the pliable paddle on the third shaft rotates at a second tangential velocity slower than the first tangential velocity.

7. A container cutting assembly comprising:

first and second parallel counter-rotatable shafts defining respective first and second axes;

a first and second plurality of cutting wheels interleaved with said second plurality of cutting wheels on said second shaft;

each cutting wheel in said first and second plurality of cutting wheels including a plurality of teeth, each tooth including a leading surface and first and second trailing surfaces, the second trailing surface having a preselected length, each leading surface and first trailing surface meeting to define a cutting edge, each cutting edge being skewed with respect to its respective axis to define a cutting point;

each cutting wheel being rotatable with its respective shaft such that each cutting point leads both the leading surface and the cutting edge of the respective tooth;

each cutting wheel being positioned on its respective shaft such that each cutting point on each tooth of each cutting wheel passes two second trailing surfaces of corresponding teeth of cutting wheels on the other shaft disposed on either side of the respective cutting wheel approximately midway along the preselected length of the two second trailing surfaces; and a housing including first and second side walls containing apertures, the first and second shafts projecting through the apertures, and first and second deflectors parallel to and proximate the side walls, the first deflector having an arcuate lower portion at least partially encircling one cutting wheel on the first shaft, the second deflector having an arcuate lower portion at least partially encircling one cutting wheel on the second shaft.

8. A container cutting assembly comprising:

first and second parallel counter-rotatable shafts defining respective first and second axes;

a first and second plurality of cutting wheels positioned on the first and second shafts, respectively, said first plurality of cutting wheels on said first shaft being interleaved with said second plurality of cutting wheels on said second shaft;

each cutting wheel in said first and second plurality of cutting wheels including a plurality of teeth, each tooth including a leading surface and first and second trailing surfaces, the second trailing surface having a preselected length, each leading surface and first trailing surface meeting to define a cutting edge, each cutting edge being skewed with respect to its respective axis to define a cutting point;

each cutting wheel being rotatable with its respective shaft such that each cutting point leads both the leading surface and the cutting edge of the respective tooth;

each cutting wheel being positioned on its respective shaft such that each cutting point on each tooth of each cutting wheel passes two second trailing surfaces of corresponding teeth of cutting wheels on the other shaft disposed on either side of the respective cutting wheel approximately midway along the preselected length of the two second trailing surfaces; and a driver including a motor for driving the shafts, and a suspension system provided between the driver and the shafts to abosrb and release excess energy applied to the assembly.

9. A container cutting assembly according to claim 8, wherein the suspension system comprises a frame member connected to the first and second shafts, a columnar member connected at one end to the driver, said columnar member penetrating and movable relative to the frame member, a compression member attached to the columnar member proximate a side of the frame member nearest the driver, and a means for absorbing and releasing energy positioned between the compression member and the frame member.

10. A container cutting assembly according to claim 9, wherein the suspension system further comprises a second compression member attached to the columnar member proximate a side of the frame member facing away from the driver, and a second means for absorbing and releasing energy positioned between the second compression member and the frame member.

11. A container cutting assembly, comprising first and second parallel counter-rotatable shafts defining respective first and second axes;

a first and second plurality of cutting wheels positioned on the first and second shafts, respectively, said first plurality of cutting wheels on said first shaft being interleaved with said second plurality of cutting Wheels on said second shaft;

each cutting wheel in said first and second plurality of cutting wheels including a plurality of teeth, each tooth including a leading surface and a trailing surface meeting to define a cutting edge, each cutting edge being skewed with respect to its respective axis to define a cutting point;

each cutting wheel being rotatable with its respective shaft such that each cutting point leads both said leading surface and said cutting edge as the wheel rotates; and each cutting wheel being positioned on its respective shaft such that the cutting points of the teeth on each cutting wheel of each respective plurality of cutting wheels align with one another defining a line parallel and coplanar to the respective axis.

12. A container cutting assembly according to claim 11, wherein each tooth is skewed between 10° and 20° with respect to its respective axis.

13. A container cutting assembly according to claim 11, wherein each tooth further comprises first and second trailing surfaces, each second trailing surface having a preselected length, and each cutting wheel is positioned on its respective shaft such that each cutting point on each tooth of each cutting wheel passes two second trailing surfaces of corresponding teeth of cutting wheels on the other shaft disposed on either side of the respective cutting wheel approximately midway along the preselected lengths of the two second trailing surfaces.

14. A container cutting assembly according to claim 11, further comprising a housing with strippers mounted on inner walls of the housing, each stripper having finger portions extending between the cutting wheels on the respective first and second shaft.

15. A container cutting assembly comprising:

first and second parallel counter-rotatable shafts defining respective first and second axes;

a first and second plurality of cutting wheels positioned on the first and second shafts, respectively, said first plurality of cutting wheels on said first shaft being interleaved with said second plurality of cutting wheels on said second shaft;

each cutting wheel in said first and second plurality of cutting wheels including a plurality of teeth, each tooth including a leading surface and a trailing surface meeting to define a cutting edge, each cutting edge being skewed with respect to its respective axis to define a cutting point;

each cutting wheel being rotatable with its respective shaft such that each cutting point leads both said leading surface and said cutting edge as the wheel rotates;

each cutting wheel being positioned on its respective shaft such that the cutting points of the teeth on each cutting wheel of each respective plurality of cutting wheels alien with one another defining a line parallel and coplanar to the respective axis; and a third rotatable shaft positioned generally above one of the first and second shafts, a pliable paddle projecting from the third shaft.

16. A container cutting assembly according to claim 15, wherein the cutting wheels on the first and second shafts rotate at a first tangential velocity, and the pliable paddle on the third shaft rotates at a second tangential velocity slower than the first tangential velocity.

17. A container cutting assembly comprising:

first and second parallel counter-rotatable shafts defining respective first and second axis;

a first and second plurality of cutting wheels positioned on the first and second shafts, respectively, said first plurality of cutting wheels on said first shaft being interleaved with said second plurality of cutting wheels on said second shaft;

each cutting wheel in said first and second plurality of cutting wheels including a plurality of teeth, each tooth including a leading surface and a trailing surface meeting to define a cutting edge, each cutting edge being skewed with respect to its respective axis to define a cutting point;

each cutting wheel being rotatable with its respective shaft such that each cutting point leads both said leading surface and said cutting edge as the wheel rotates;

each cutting wheel being positioned on its respective shaft such that the cutting points of the teeth on each cutting wheel of each respective plurality of cutting wheels align with one another defining a line parallel and coplanar to the respective axis; and a housing including first and second side walls containing apertures, the first and second shafts projecting through the apertures, and first and second deflectors parallel to and proximate the side walls, the first reflector having an arcuate lower portion at least partially encircling one cutting wheel on the first shaft, the second deflector having an accurate lower portion at least partially encircling one cutting wheel on the second shaft.

18. A containing cutting assembly comprising:

first and second parallel counter-rotatable shafts defining respective first and second axes;

a first and second plurality of cutting wheels positioned on the first and second shafts, respectively, said first plurality of cutting wheels on said first shaft being interleaved with said second plurality of cutting wheels on said second shaft;

each cutting wheel in said first and second plurality of cutting wheels including a plurality of teeth, each tooth including a leading surface and a trailing surface meeting to define a cutting edge, each cutting edge being skewed with respect to its respective axis to define a cutting point;

each cutting wheel being rotatable with its respective shaft such that each cutting point leads both said leading surface and said cutting edge as the wheel rotates;

each cutting wheel being positioned on its respective shaft such that the cutting points of the teeth on each cutting wheel of each respective plurality of cutting wheels align with one another defining a line parallel and coplanar to the respective axis; and a driver including a motor for driving the shafts, and a suspension system provided between the driver and the shafts to absorb and release excess energy applied to the assembly.

19. A container cutting assembly according to claim 18 wherein the suspension system comprises a frame member connected to the first and second shafts, a columnar member connected at one end to the driver, said columnar member penetrating and movable relative to the frame member, a compression member attached to the columnar member proximate a side of the frame member nearest the driver, and a means for absorbing and releasing energy positioned between the compression member and the frame member.

20. A container cutting assembly according to claim 19, wherein the suspension system further comprises a second compression member attached to the columnar member proximate a side of the frame member facing away from the driver, and a second means for absorbing and releasing energy positioned between the second compression member and the frame member.

21. A container cutting assembly comprising: first and second parallel counter-rotating shafts;

a first and second plurality of cutting wheels positioned on the first and second shafts, respectively, said first plurality of cutting wheels on said first shaft being interleaved with said second plurality of cutting wheels on said second shaft;

a driver including a motor for driving the shafts; and a suspension system provided between the driver and the shafts to absorb and release excess energy applied to the assembly, wherein the suspension system comprises a frame member connected to the first and second shafts, a columnar member connected at one end to the driver, said columnar member penetrating and movable relative to the frame member, a compression member attached to the columnar member proximate a side of the frame member nearest the driver, and a means for absorbing and releasing energy positioned between the compression member and the frame member.

22. A container cutting assembly according to claim 21, wherein the suspension system further comprises a second compression member attached to the columnar member proximate a side of the frame member facing away from the driver, and a second means for absorbing and releasing energy positioned between the second compression member and the frame member.

23. A reverse vending machine, comprising:

(a) a cabinet;

(b) an acceptance mechanism in the cabinet for receiving a container;

(c) a container cutting assembly in the cabinet comprising:

first and second counter-rotatable shafts defining respective first and second axes;

a first and second plurality of cutting wheels positioned on the first and second shafts, respectively, said first plurality of cutting wheels on said first shaft being interleaved with said second plurality of cutting wheels on said second shaft;

each cutting wheel in said first and second plurality of cutting wheels including a plurality of teeth, each tooth including a leading surface and first and second trailing surfaces, the second trailing surface having a preselected length, each leading surface and first trailing surface meeting to define a cutting edge, each cutting edge being skewed with respect to its respective axis to define a cutting point;

each cutting wheel being rotatable with its respective shaft such that each cutting point leads both the leading surface and the cutting edge of its respective tooth;

each cutting wheel being positioned on its respective shaft such that each cutting point on each tooth of each cutting wheel passes two second trailing surfaces of corresponding teeth of cutting wheels on the other shaft disposed on either side of the respective cutting wheel approximately midway along the preselected lengths of the two second trailing surfaces;

(d) a device in the cabinet for issuing a refund in exchange for the container; and (e) a storage bin configured to receive the container cuttings.

24. A reverse vending machine according to claim 23, wherein each tooth in the container cutting assembly is skewed between 10° and 20° with respect to the first and second axes.

25. A reverse vending machine according to claim 23, wherein the container cutting assembly further comprises a third rotatable shaft positioned generally above one of the first and second shafts, a pliable paddle projecting from the third shaft.

26. A reverse vending machine according to claim 25, wherein the cutting wheels on the first and second shafts rotate at a first tangential velocity, and the pliable paddle on the third shaft rotates at a second tangential velocity slower than the first tangential velocity.

27. A reverse vending machine according to claim 23, wherein the cutting points of the teeth on each cutting wheel of each respective plurality of cutting wheels align with one another defining a line parallel and coplanar to the respective axis.

28. A reverse vending machine according to claim 23, wherein the container cutting assembly further comprises a housing including first and second side walls containing apertures the first and second shafts projecting through the apertures, and first and second deflectors parallel to and proximate the side walls, the first deflector having an arcuate lower portion at least partially encircling one cutting wheel on the first shaft, the second deflector having an arcuate lower portion at least partially encircling one cutting wheel on the second shaft.

29. A reverse vending machine according to claim 23, further comprising a driver including a motor for driving the shafts and a suspension system provided between the driver and the shafts to absorb and release excess energy applied to the container cutting assembly.

30. A reverse vending machine according to claim 29, wherein the suspension system comprises a frame member connected to the first and second shafts, a columnar member connected at one end to the driver, said columnar member penetrating and movable relative to the frame member, a compression member attached to the columnar member proximate a side of the frame member nearest the driver, and a means for absorbing and releasing energy positioned between the compression member and the frame member.

31. A reverse vending machine according to claim 30, wherein the suspension system further comprises a second compression member attached to the columnar member proximate a side of the frame member facing away from the driver, and a second means for absorbing and releasing energy positioned between the second compression member and the frame member.

32. A reverse vending machine according to claim 23, wherein the container cutting assembly further comprises a housing with strippers mounted on inner walls of the housing, having finger portions extending between the cutting wheels on the respective first and second shaft.

33. A reverse vending machine comprising:

(a) a cabinet;

(b) an acceptance mechanism in the cabinet for receiving a container;

(c) a container cutting assembly in the cabinet comprising:

first and second parallel counter-rotatable shafts defining respective first and second axes;

a first and second plurality of cutting wheels positioned on the first and second shafts, respectively, said first plurality of cutting wheels on said first shaft being interleaved with said second plurality of cutting wheels on said second shaft;

each cutting wheel in said first and second plurality of cutting wheels including a plurality of teeth, each tooth including a leading surface and a trailing surface meeting to define a cutting edge, each cutting edge being skewed with respect to its respective axis to define a cutting point;

each cutting wheel being rotatable with its respective shaft such that each cutting point leads both said leading surface and said cutting edge as the wheel rotates; and each cutting wheel being positioned on its respective shaft such that the cutting points of the teeth on each cutting wheel of each respective plurality of cutting wheels align with one another defining a line parallel and coplanar to the respective axis;

(d) a device in the cabinet for issuing a refund in exchange for the container; and (e) a storage bin configured to receive the container cuttings.

34. A reverse vending machine according to claim 33, wherein each tooth in the container cutting assembly is skewed between 10° and 20° with respect to the first and second axes.

35. A reverse vending machine according to claim 33, wherein the container cutting assembly further comprises a third rotatable shaft positioned generally above one of the first and second shafts, a pliable paddle projecting from the third shaft.

36. A reverse vending machine according to claim 35, wherein the cutting wheels on the first and second shafts rotate at a first tangential velocity, and the pliable paddle on the third shaft rotates at a second tangential velocity slower than the first tangential velocity.

37. A reverse vending machine according to claim 33, wherein each tooth further comprises first and second trailing surfaces, each second trailing surface having a preselected length, and each cutting wheel is positioned on its respective shaft such that each cutting point on each tooth of each cutting wheel passes two second trailing surfaces of corresponding teeth of cutting wheels on the other shaft disposed on either side of the respective cutting wheel approximately midway along the preselected lengths of the two second trailing surfaces.

38. A reverse vending machine according to claim 33, wherein the container cutting assembly further comprises a housing including first and second side walls containing apertures, the first and second shafts projecting through the apertures, and first and second deflectors parallel to and proximate the side walls, the first deflector having an arcuate lower portion at least partially encircling one cutting wheel on the first shaft, the second deflector having an arcuate lower portion at least partially encircling one cutting wheel on the second shaft.

39. A reverse vending machine according to claim 33, further comprising a driver including a motor for driving the shafts, and a spring-loaded suspension system provided between the driver and the shafts to absorb excess energy applied to the container cutting assembly.

40. A reverse vending machine according to claim 39, wherein the suspension system comprises a frame member connected to the first and second shafts, a columnar member connected at one end to the driver, said columnar member penetrating and movable relative to the frame member, a compression member attached to the columnar member proximate a side of the frame member nearest the driver, and a means for absorbing and releasing energy positioned between the compression member and the frame member.

41. A reverse vending machine according to claim 40, wherein the suspension system further comprises a second compression member attached to the columnar member proximate a side of the frame member facing away from the driver, and a second means for absorbing and releasing energy positioned between the second compression member and the frame member.

42. A reverse vending machine according to claim 33, wherein the container cutting assembly further comprises a housing with strippers mounted on inner walls of the housing, having finger portions extending between the cutting wheels on the respective first and second shaft.

43. A reverse vending machine, comprising:

(a) a cabinet;

(b) an acceptance mechanism in the cabinet for receiving a container;

(c) a container cutting assembly in the cabinet comprising:

first and second parallel counter-rotating shafts;

a first and second plurality of cutting wheels positioned on the first and second shafts, respectively, said first plurality of cutting wheels on said first shaft being interleaved with said second plurality of cutting wheels on said second shaft;

a driver, including a motor for driving the shafts; and a suspension system provided between the driver and the shafts to absorb and release excess energy applied to the assembly, wherein the suspension system comprises a frame member connected to the first and second shafts, a columnar member connected at one end to the driver, said columnar member penetrating and movable relative to the frame member, a compression member attached to the columnar member proximate a side of the frame member nearest the driver, and a means for absorbing and releasing energy positioned between the compression member and the frame member;

(d) a device in the cabinet for issuing a refund in exchange for the container; and (e) a storage bin configured to receive the container cuttings.

44. A reverse vending machine according to claim 43, wherein the suspension system further comprises a second compression member attached to the columnar member proximate a side of the frame member facing away from the driver, and a second means for absorbing and releasing energy positioned between the second compression member and the frame member.

* * * * *

UNITED STATES PATENT AND TRADEMARK OFFICE

CERTIFICATE OF CORRECTION

PATENT NO. : 5,560,552

DATED : October 1, 1996

INVENTOR(S) : Ken R. Powell et al.

It is certified that error appears in the above-indentified patent and that said Letters Patent is hereby corrected as shown below:

On the title page: Item [75] delete ", both of Va."

Claim 5, column 13, line 28, after "said" insert --second shaft,--.

Claim 7, column 13, line 59, before "interleaved" insert --positioned on the first and second shafts, respectively, said first plurality of cutting wheels on said first shaft being--.

Claim 11, column 15, line 7, change "Wheels" to --wheels--.

Claim 15, column 15, line 63, change "alien" to --align--.

Claim 17, column 16, line 8, change "axis" to --axes--;

column 16, line 36, change "accurate" to --arcuate--.

Signed and Sealed this

Twenty-ninth Day of April, 1997

*Attest:*

*Attesting Officer*

Bruce Lehman

BRUCE LEHMAN

*Commissioner of Patents and Trademarks*